US011047157B1

(12) United States Patent
Liang et al.

(10) Patent No.: US 11,047,157 B1
(45) **Date of Patent: *Jun. 29, 2021**

(54) VENT STOP

(71) Applicant: Vision Industries Group, Inc., So. Plainfield, NJ (US)

(72) Inventors: Luke Liang, So. Plainfield, NJ (US); David Chen, Guangzhou (CN)

(73) Assignee: Vision Industries Group, Inc., So. Plainfield, NJ (US)

( * ) Notice: Subject to any disclaimer, the term of this patent is extended or adjusted under 35 U.S.C. 154(b) by 416 days.

This patent is subject to a terminal disclaimer.

(21) Appl. No.: 16/051,610

(22) Filed: Aug. 1, 2018

Related U.S. Application Data

(60) Continuation-in-part of application No. 15/791,676, filed on Oct. 24, 2017, now Pat. No. 10,107,021,
(Continued)

(51) Int. Cl.

| | |
|---|---|
| ***E05C 17/60*** | (2006.01) |
| ***E05C 3/12*** | (2006.01) |
| ***E05B 15/04*** | (2006.01) |
| ***E05C 3/14*** | (2006.01) |
| ***E05B 65/08*** | (2006.01) |

(Continued)

(52) U.S. Cl.
CPC ..... *E05C 17/60* (2013.01); *E05B 9/08* (2013.01); *E05B 15/0053* (2013.01); *E05B 15/04* (2013.01); *E05B 65/0811* (2013.01); *E05C 3/124* (2013.01); *E05C 3/14* (2013.01); *E06B 7/02* (2013.01); *E06B 7/28* (2013.01); *E05B 65/0829* (2013.01); *E05B 2015/0496* (2013.01); *E05C 2007/007* (2013.01); *Y10S 292/20* (2013.01); *Y10S 292/46* (2013.01); *Y10S 292/47* (2013.01); *Y10T 292/1051* (2015.04);
(Continued)

(58) Field of Classification Search
USPC ..... 292/338, 339
See application file for complete search history.

(56) References Cited

U.S. PATENT DOCUMENTS

| | | | |
|---|---|---|---|
| 16,228 | A | 12/1856 | Copeland |
| 30,408 | A | 10/1860 | Judd |

(Continued)

FOREIGN PATENT DOCUMENTS

| | | |
|---|---|---|
| GB | 2 286 627 | 8/1995 |
| GB | 2 461 079 | 12/2009 |

(Continued)

*Primary Examiner* — Carlos Lugo
(74) *Attorney, Agent, or Firm* — Thomas A. O'Rourke; Bodner + O'Rourke, LLP

(57) ABSTRACT

A window vent stop for use in a sliding sash window or a sliding sash door assembly. The vent stop includes a housing and a tumbler. The housing is adapted to be disposed in a recess in a rail or stile of the window/door. This housing includes a cavity with a bottom wall therein. The tumbler has at least one pivot for pivotally securing the tumbler to the housing for movement between an extended position, to prevent movement of the sliding member, and a retracted position, to allow movement of the sliding member. The tumbler is formed with a protruding spring member for selectively biasing the tumbler. The housing has one or more flexible members extending from each of its end walls to secure the housing within the opening in the sash member.

14 Claims, 31 Drawing Sheets

Related U.S. Application Data which is a continuation-in-part of application No. 15/484,295, filed on Apr. 11, 2017, now Pat. No. 10,053,896, which is a continuation of application No. 15/471,158, filed on Mar. 28, 2017, now abandoned, which is a continuation of application No. 14/198,949, filed on Mar. 6, 2014, now Pat. No. 10,006,232, which is a continuation of application No. 12/658,642, filed on Feb. 9, 2010, now Pat. No. 8,833,809, which is a division of application No. 11/977,445, filed on Oct. 24, 2007, now Pat. No. 8,235,430, which is a continuation-in-part of application No. 11/390,467, filed on Mar. 28, 2006, now Pat. No. 7,530,611.

(51) Int. Cl.

| | |
|---|---|
| ***E06B 7/28*** | (2006.01) |
| ***E05B 15/00*** | (2006.01) |
| ***E05B 9/08*** | (2006.01) |
| ***E06B 7/02*** | (2006.01) |
| *E05C 7/00* | (2006.01) |

(52) U.S. Cl.

CPC .... *Y10T 292/1052* (2015.04); *Y10T 292/1061* (2015.04); *Y10T 292/65* (2015.04)

(56) References Cited

U.S. PATENT DOCUMENTS

| | | | |
|---|---|---|---|
| 35,524 | A | 9/1862 | Minor |
| 51,222 | A | 11/1865 | Ridell |
| 108,778 | A | 11/1870 | Gorman |
| 115,781 | A | 6/1871 | Steele |
| 126,872 | A | 5/1872 | Buckman |
| 148,857 | A | 3/1874 | Smith |
| 163,008 | A | 5/1875 | Gillespie |
| 166,842 | A | 8/1875 | Berryman |
| 178,360 | A | 6/1876 | Cooper |
| 190,074 | A | 4/1877 | Penfield |
| 192,614 | A | 7/1877 | Andrews |
| 192,919 | A | 7/1877 | Ho |
| 201,146 | A | 3/1878 | Adler |
| 226,033 | A | 3/1880 | Burns |
| 230,476 | A | 7/1880 | Green |
| 234,387 | A | 11/1880 | Burgess |
| 284,993 | A | 9/1883 | Abele |
| 314,350 | A | 3/1885 | Smith |
| 316,285 | A | 4/1885 | McKeen |
| 331,005 | A | 11/1885 | Sahr |
| 336,302 | A | 2/1886 | Dudgeon |
| 346,788 | A | 8/1886 | Teufel |
| 350,678 | A | 10/1886 | Hussey |
| 353,287 | A | 11/1886 | Chumard |
| 368,595 | A | 8/1887 | King |
| 369,885 | A | 9/1887 | Shaw |
| 375,656 | A | 12/1887 | Shaw |
| 376,252 | A | 1/1888 | McIntyre |
| 379,910 | A | 3/1888 | Rosentreter |
| 410,728 | A | 9/1889 | Brown |
| 417,868 | A | 12/1889 | Jones |
| 423,761 | A | 3/1890 | Hasenpflug |
| 426,303 | A | 4/1890 | McGovern |
| 447,068 | A | 2/1891 | Dixon |
| 452,723 | A | 5/1891 | Schmalhausen |
| 471,363 | A | 3/1892 | Sloan |
| 480,148 | A | 8/1892 | Theby |
| 493,159 | A | 3/1893 | Gibson |
| 509,941 | A | 12/1893 | Perry |
| 512,593 | A | 1/1894 | Webster |
| 520,754 | A | 5/1894 | Burmeister |
| 526,118 | A | 9/1894 | Sharp |
| 528,656 | A | 11/1894 | Burmeister |
| 530,078 | A | 12/1894 | Ammerman |
| 534,185 | A | 2/1895 | Winchester |
| 537,258 | A | 4/1895 | Wilcox |
| 539,030 | A | 5/1895 | Bitner |
| 551,181 | A | 12/1895 | Dillon |
| 551,242 | A | 12/1895 | Wallace |
| 554,448 | A | 2/1896 | Keil |
| 564,426 | A | 7/1896 | Hubbard |
| 572,591 | A | 12/1896 | Woodard |
| 587,424 | A | 8/1897 | Bonine |
| 590,225 | A | 9/1897 | Hill |
| 653,458 | A | 7/1900 | Paquette |
| 666,596 | A | 1/1901 | Breen |
| 683,928 | A | 10/1901 | Geraghty |
| 688,491 | A | 12/1901 | Sigler |
| 695,736 | A | 3/1902 | Kendrick |
| 698,742 | A | 4/1902 | Schamweber |
| 699,696 | A | 5/1902 | Mellen |
| 708,406 | A | 9/1902 | Robison |
| 714,343 | A | 11/1902 | Wellman |
| 718,007 | A | 1/1903 | Linn |
| 719,981 | A | 2/1903 | Adams |
| 722,162 | A | 3/1903 | St. Louis |
| 724,466 | A | 4/1903 | Hannan |
| 743,716 | A | 11/1903 | Hedka |
| 744,755 | A | 11/1903 | Hasenpflug |
| 745,888 | A | 12/1903 | McElwee |
| 749,469 | A | 1/1904 | Assorati |
| 756,453 | A | 4/1904 | Arens |
| 756,559 | A | 4/1904 | Arens |
| 757,249 | A | 4/1904 | Barnard |
| 759,642 | A | 5/1904 | Sparks |
| 764,493 | A | 7/1904 | Noseworthy |
| 769,386 | A | 9/1904 | Johnson |
| 769,767 | A | 9/1904 | Phelps |
| 774,536 | A | 11/1904 | Saunders |
| 775,602 | A | 11/1904 | Hearnshaw |
| 800,043 | A | 9/1905 | Witte |
| 804,994 | A | 11/1905 | Andrews |
| 815,537 | A | 3/1906 | Kissinger |
| 833,900 | A | 10/1906 | Sigler |
| 837,811 | A | 12/1906 | Ebbeson |
| 840,427 | A | 1/1907 | Brister |
| 865,090 | A | 9/1907 | Eddy |
| 866,073 | A | 9/1907 | Saunders |
| 878,206 | A | 2/1908 | Johnson |
| 881,658 | A | 3/1908 | Bowman |
| 886,108 | A | 4/1908 | Allen |
| 887,690 | A | 5/1908 | Pearce |
| 922,894 | A | 5/1908 | Heid |
| 897,719 | A | 9/1908 | Daubaignan |
| 900,079 | A | 10/1908 | Bittorf |
| 910,850 | A | 1/1909 | Petrie |
| 913,730 | A | 3/1909 | Kapus |
| 926,899 | A | 7/1909 | Roy |
| 928,408 | A | 7/1909 | Taube |
| 948,628 | A | 2/1910 | Jefferis |
| 959,150 | A | 5/1910 | Morris |
| 963,983 | A | 7/1910 | Bernhard |
| 966,063 | A | 8/1910 | Toothaker |
| 976,777 | A | 11/1910 | Brown |
| 980,131 | A | 12/1910 | Shean |
| 998,642 | A | 7/1911 | Shean |
| 1,003,386 | A | 9/1911 | Welker |
| 1,006,211 | A | 10/1911 | Hermon |
| 1,020,454 | A | 3/1912 | Seidenbecker |
| 1,041,803 | A | 10/1912 | Kilburn |
| 1,051,918 | A | 2/1913 | Rowley |
| 1,059,999 | A | 4/1913 | James |
| 1,069,079 | A | 7/1913 | Voight |
| 1,077,487 | A | 11/1913 | Miller |
| 1,080,172 | A | 12/1913 | Rusk |
| 1,100,820 | A | 6/1914 | Edwards |
| 1,121,228 | A | 12/1914 | Burkhart |
| 1,122,026 | A | 12/1914 | O'Rourke |
| 1,127,835 | A | 2/1915 | Westlund |
| 1,133,217 | A | 3/1915 | Barton |
| 1,141,437 | A | 6/1915 | Unterlender |
| 1,148,712 | A | 8/1915 | Overland |
| 1,163,083 | A | 12/1915 | Harper |

(56) References Cited

U.S. PATENT DOCUMENTS

| | | | |
|---|---|---|---|
| 1,173,129 | A | 2/1916 | Taliaferro |
| 1,177,637 | A | 4/1916 | Lane |
| 1,177,838 | A | 4/1916 | Wilkinson |
| 1,207,989 | A | 12/1916 | O'Rourke |
| 1,232,683 | A | 7/1917 | Hollis |
| 1,243,115 | A | 10/1917 | Shur |
| 1,244,725 | A | 10/1917 | Gadke |
| 1,253,810 | A | 1/1918 | Gianninoto |
| 1,261,274 | A | 4/1918 | Newsam |
| 1,269,467 | A | 6/1918 | Winters |
| 1,270,740 | A | 6/1918 | Keyes |
| 1,272,900 | A | 7/1918 | Berman |
| 1,279,353 | A | 9/1918 | Kelley |
| 1,322,677 | A | 1/1919 | Ditlefsen |
| 1,311,052 | A | 7/1919 | Danforth |
| 1,338,250 | A | 4/1920 | Parkes |
| 1,338,416 | A | 4/1920 | Bellinger |
| 1,339,362 | A | 5/1920 | L'Heureux |
| 1,341,234 | A | 5/1920 | Horton |
| 1,350,698 | A | 8/1920 | Boedtcher |
| 1,387,302 | A | 8/1921 | Page |
| 1,388,272 | A | 8/1921 | Lawrence |
| 1,393,628 | A | 10/1921 | Leichter |
| 1,398,174 | A | 11/1921 | Carlson |
| 1,399,897 | A | 12/1921 | Singer |
| 1,412,154 | A | 4/1922 | Wollesen |
| 1,439,585 | A | 12/1922 | Trost |
| 1,461,467 | A | 7/1923 | Stuart |
| 1,463,866 | A | 8/1923 | Bourbeau |
| 1,470,858 | A | 10/1923 | Maxwell |
| 1,485,382 | A | 3/1924 | Foley |
| 1,490,874 | A | 4/1924 | Webb |
| 1,516,995 | A | 11/1924 | Trigueiro |
| 1,550,532 | A | 8/1925 | French |
| 1,552,690 | A | 9/1925 | Frantz |
| 1,587,037 | A | 6/1926 | Rudolph |
| 1,601,051 | A | 9/1926 | Wilbert |
| 1,605,717 | A | 11/1926 | Gregg |
| 1,619,031 | A | 3/1927 | Ostrosky |
| 1,622,742 | A | 3/1927 | Shipman |
| 1,656,818 | A | 1/1928 | Dillon |
| 1,692,579 | A | 11/1928 | Schrader |
| 1,704,946 | A | 3/1929 | Lindgren |
| 1,712,792 | A | 5/1929 | Hansen |
| 1,715,957 | A | 6/1929 | Stein |
| 1,724,637 | A | 8/1929 | Bergstrom |
| 1,750,715 | A | 3/1930 | Jeffers |
| 1,794,171 | A | 2/1931 | Grutel |
| 1,812,288 | A | 6/1931 | Drapeau |
| 1,819,824 | A | 8/1931 | McAllister |
| 1,864,253 | A | 6/1932 | McIntyre |
| 1,869,274 | A | 7/1932 | Phillips |
| 1,877,177 | A | 9/1932 | Hinderer |
| 1,891,940 | A | 12/1932 | McAllister |
| 1,900,936 | A | 3/1933 | Huttger |
| 1,901,974 | A | 3/1933 | Macy |
| 1,918,114 | A | 7/1933 | Lorenzen |
| 1,922,062 | A | 8/1933 | Sullivan |
| 1,940,084 | A | 12/1933 | Grasso |
| 1,960,034 | A | 5/1934 | Stewart |
| 1,964,114 | A | 6/1934 | Gerlach |
| 2,085,057 | A | 10/1937 | Corrado |
| 2,122,661 | A | 7/1938 | Rightmyer |
| 2,126,995 | A | 8/1938 | Kingdon |
| 2,136,408 | A | 11/1938 | Bedell |
| 2,158,260 | A | 5/1939 | Stillman |
| 2,202,561 | A | 5/1940 | Lehiere |
| 2,232,965 | A | 2/1941 | Perl |
| 2,272,145 | A | 2/1942 | Anderson |
| 2,326,084 | A | 8/1943 | Westrope |
| 2,369,584 | A | 2/1945 | Lundholm |
| 2,452,521 | A | 10/1948 | Johnson |
| 2,480,016 | A | 8/1949 | Granberg |
| 2,480,988 | A | 9/1949 | Walton |
| 2,500,349 | A | 3/1950 | Menns |
| 2,503,370 | A | 4/1950 | Zanona |
| 2,523,559 | A | 9/1950 | Couture |
| 2,527,278 | A | 10/1950 | Schemansky |
| 2,537,736 | A | 1/1951 | Carlson |
| 2,560,274 | A | 7/1951 | Cantelo |
| 2,581,816 | A | 1/1952 | Schlueter |
| 2,590,624 | A | 3/1952 | James |
| 2,599,196 | A | 6/1952 | Peremi |
| 2,605,125 | A | 7/1952 | Emerson |
| 2,612,398 | A | 9/1952 | Miller |
| 2,613,526 | A | 10/1952 | Holmsten |
| 2,621,951 | A | 12/1952 | Ostadal |
| 2,645,515 | A | 7/1953 | Thomas |
| 2,648,967 | A | 8/1953 | Holmsten |
| 2,670,982 | A | 3/1954 | Banham |
| 2,692,789 | A | 10/1954 | Rivard |
| 2,735,707 | A | 2/1956 | Sylvan |
| 2,758,862 | A | 8/1956 | Endter |
| 2,766,492 | A | 10/1956 | Day |
| 2,789,851 | A | 4/1957 | Lickteig |
| 2,818,919 | A | 1/1958 | Sylvan |
| 2,846,258 | A | 8/1958 | Granberg |
| 2,855,772 | A | 10/1958 | Hillgren |
| 2,884,276 | A | 4/1959 | Baptist |
| 2,920,914 | A | 1/1960 | Jenkins |
| 2,941,832 | A | 6/1960 | Grossman |
| 2,997,323 | A | 8/1961 | Riser |
| 3,027,188 | A | 3/1962 | Eichstadt |
| 3,122,387 | A | 2/1964 | Wakelin |
| 3,135,542 | A | 6/1964 | Wilkenson |
| 3,187,526 | A | 6/1965 | Moler |
| 3,267,613 | A | 8/1966 | McQuiston |
| 3,288,510 | A | 11/1966 | Gough |
| 3,352,586 | A | 11/1967 | Hakanson |
| 3,362,740 | A | 1/1969 | Burns |
| 3,422,575 | A | 1/1969 | Armstrong |
| 3,425,729 | A | 2/1969 | Bisbing |
| 3,438,153 | A | 4/1969 | Lemme |
| 3,469,877 | A | 9/1969 | Hutchison |
| 3,599,452 | A | 8/1971 | Maruyama |
| 3,600,019 | A | 8/1971 | Toyota |
| 3,642,315 | A | 2/1972 | Alpern |
| 3,645,573 | A | 2/1972 | Strang |
| 3,683,652 | A | 8/1972 | Halopoff |
| 3,706,467 | A | 12/1972 | Martin |
| 3,762,750 | A | 10/1973 | Orr |
| 3,811,718 | A | 5/1974 | Bates |
| 3,907,348 | A | 9/1975 | Bates |
| 3,919,808 | A | 11/1975 | Simmons |
| 3,927,906 | A | 12/1975 | Mieras |
| 3,930,678 | A | 1/1976 | Alexander |
| 4,054,308 | A | 10/1977 | Prohaska |
| 4,059,298 | A | 11/1977 | Van Klompenburg |
| 4,063,766 | A | 12/1977 | Granberg |
| 4,068,871 | A | 1/1978 | Mercer |
| 4,095,827 | A | 6/1978 | Stavenau |
| 4,095,829 | A | 6/1978 | Van Klompenburg |
| 4,102,546 | A | 7/1978 | Costello |
| 4,151,682 | A | 5/1979 | Schmidt |
| 4,165,894 | A | 8/1979 | Wojciechowski |
| 4,223,930 | A | 9/1980 | Costello |
| 4,227,345 | A | 10/1980 | Durham |
| 4,235,465 | A | 11/1980 | Costello |
| 4,253,688 | A | 3/1981 | Hosooka |
| 4,261,602 | A | 4/1981 | Anderson |
| 4,274,666 | A | 6/1981 | Peck |
| 4,293,154 | A | 10/1981 | Cassells |
| 4,303,264 | A | 12/1981 | Uehara |
| 4,305,612 | A | 12/1981 | Hunt |
| 4,392,329 | A | 7/1983 | Suzuki |
| 4,429,910 | A | 2/1984 | Anderson |
| 4,470,277 | A | 9/1984 | Uyeda |
| 4,475,311 | A | 10/1984 | Gibson |
| 4,525,952 | A | 7/1985 | Cunningham |
| 4,580,366 | A | 4/1986 | Hardy |
| 4,587,759 | A | 5/1986 | Gray |
| 4,621,847 | A | 11/1986 | Paulson |
| 4,624,073 | A | 11/1986 | Randall |
| 4,639,021 | A | 1/1987 | Hope |

(56) References Cited

U.S. PATENT DOCUMENTS 4,643,005 A 2/1987 Logas
4,655,489 A 4/1987 Bisbing
4,736,972 A 4/1988 Mosch
4,801,164 A 1/1989 Mosch
4,813,725 A 3/1989 Mosch
4,824,154 A 4/1989 Simpson
4,826,222 A 5/1989 Davis
4,827,685 A 5/1989 Schmidt
4,893,849 A 1/1990 Schlack
4,922,658 A 5/1990 Coddens
4,923,230 A 5/1990 Simpson
4,949,506 A 8/1990 Durham
4,961,286 A 10/1990 Bezubic
4,991,886 A 2/1991 Nolte
5,042,855 A 8/1991 Bennett
5,072,464 A 12/1991 Draheim
5,076,015 A 12/1991 Manzalini
5,087,087 A 2/1992 Vetter
5,087,088 A 2/1992 Milam
5,090,750 A 2/1992 Lindqvist
5,090,754 A 2/1992 Thompson
5,092,640 A 3/1992 Plummer
5,110,165 A 5/1992 Piltingsrud
5,127,685 A 7/1992 Dallaire
5,139,291 A 8/1992 Schultz
5,143,412 A 9/1992 Lindqvist
5,161,839 A 11/1992 Piltingsrud
5,165,737 A 11/1992 Riegelman
5,183,310 A 2/1993 Shaughnessy
5,217,264 A 6/1993 Fier
5,219,193 A 6/1993 Piltingsrud
5,244,238 A 9/1993 Lindqvist
5,248,174 A 9/1993 Matz
5,274,955 A 1/1994 Dallaire
5,341,752 A 8/1994 Hambleton
5,398,447 A 3/1995 Morse
5,437,484 A 8/1995 Yamada
5,448,857 A 9/1995 Stormo
5,452,925 A 9/1995 Huang
5,454,609 A 10/1995 Slocomb
5,536,052 A 7/1996 Maier
5,553,903 A 9/1996 Prete
5,560,149 A 10/1996 Lafevre
5,575,116 A 11/1996 Carlson
5,582,445 A 12/1996 Olsen
RE35,463 E 2/1997 Vetter
5,636,475 A 6/1997 Nidelkoff
5,688,000 A 11/1997 Dolman
5,715,631 A 2/1998 Kailian
5,741,032 A 4/1998 Chaput
5,778,602 A 7/1998 Johnson
5,791,700 A 8/1998 Biro
5,806,900 A 9/1998 Bratcher
5,829,196 A 11/1998 Maier
5,839,767 A 11/1998 Piltingsrud
5,901,499 A 5/1999 Delaske
5,901,501 A 5/1999 Fountaine
5,911,763 A 6/1999 Quesada
5,927,768 A 7/1999 Dallmann
5,970,656 A 10/1999 Maier
5,992,907 A 11/1999 Sheldon
6,000,735 A 12/1999 Jourdenais
6,086,121 A 7/2000 Buckland
6,116,665 A 9/2000 Subliskey
6,135,510 A 10/2000 Diginosa
6,139,071 A 10/2000 Hopper
6,142,541 A 11/2000 Rotondi
6,155,615 A 12/2000 Schulz
6,176,041 B1 1/2001 Roberts
6,178,696 B1 1/2001 Liang
6,183,024 B1 2/2001 Schultz
6,209,931 B1 4/2001 Von Stoutenborough
6,217,087 B1 4/2001 Fuller
6,230,443 B1 5/2001 Schultz
6,250,694 B1 6/2001 Weiland
6,279,266 B1 8/2001 Searcy
6,349,576 B2 2/2002 Subliskey
6,364,375 B1 4/2002 Szapucki
6,450,544 B2 9/2002 Rotondi
6,546,671 B2 4/2003 Mitchell
6,565,133 B1 5/2003 Timothy
6,568,723 B2 5/2003 Murphy
6,588,150 B1 7/2003 Wong
6,592,155 B1 7/2003 Lemley
6,607,221 B1 8/2003 Elliott
6,631,931 B2 10/2003 Magnusson
6,634,683 B1 10/2003 Brannan
6,688,659 B2 2/2004 Kobrehel
6,817,142 B2 11/2004 Marshik
6,848,728 B2 2/2005 Rotondi
6,871,885 B2 3/2005 Goldenberg
6,871,886 B2 3/2005 Coleman
6,877,784 B2 4/2005 Kelley
6,925,758 B2 8/2005 Petit
6,957,513 B2 10/2005 Pettit
6,983,963 B2 1/2006 Eslick
7,000,957 B2 2/2006 Lawrence
7,013,603 B2 3/2006 Eenigenburg
7,017,957 B2 3/2006 Murphy
7,036,851 B2 5/2006 Romig
7,063,361 B1 6/2006 Lawrence
7,070,211 B2 7/2006 Polowinczak
7,070,215 B2 7/2006 Kelley
7,100,951 B2 9/2006 Jien
7,147,255 B2 12/2006 Goldenberg
7,159,908 B2 1/2007 Liang
7,171,784 B2 2/2007 Eenigenburg
7,296,831 B2 11/2007 Generowicz
7,322,619 B2 1/2008 Nolte
7,322,620 B1 1/2008 Lawrence
7,407,199 B2 8/2008 Richardson
7,431,356 B2 10/2008 Liang
7,441,811 B2 10/2008 Lawrence
7,481,470 B2 1/2009 Eenigenburg
7,510,221 B2 3/2009 Eenigenburg
7,530,611 B2 5/2009 Liang
7,559,588 B2 7/2009 Liang
7,607,262 B2 10/2009 Pettit
7,637,544 B2 12/2009 Liang
7,665,775 B1 2/2010 Miller
7,699,365 B2 4/2010 Liang
7,922,223 B2 4/2011 Lawrence
7,976,077 B2 7/2011 Flory
8,205,919 B2 6/2012 Flory
8,205,920 B2 6/2012 Flory
8,220,846 B2 7/2012 Liang
8,231,148 B2 7/2012 Van Der Kooij
8,235,430 B2 8/2012 Ling
8,272,164 B2 9/2012 Albrecht
8,336,930 B2 12/2012 Liang
8,360,484 B2 1/2013 Liang et al.
8,414,039 B2 4/2013 Liang
8,511,724 B2 8/2013 Liang
8,550,507 B2 10/2013 Barton
8,567,830 B2 10/2013 Liang
8,657,347 B2 2/2014 Liang
8,726,572 B2 5/2014 Derham
8,789,857 B2 7/2014 Liang
8,789,862 B2 7/2014 Liang
8,803,809 B2 9/2014 Liang
8,844,985 B2 9/2014 Liang
8,870,244 B2 10/2014 Liang
8,881,461 B2 11/2014 Derham
9,103,144 B2 8/2015 Liang
9,140,033 B2 9/2015 Wolf
9,376,834 B2 6/2016 Liang
9,493,970 B2 11/2016 Campbell
9,816,300 B2 11/2017 Derham
10,107,021 B1 * 10/2018 Liang ..... E05C 3/04
2006/0192391 A1 8/2006 Pettit
2006/0244270 A1 11/2006 Rotondi
2007/0205615 A1 9/2007 Eenigenburg
2008/0012358 A1 1/2008 Liang
2008/0022728 A1 1/2008 Flory

(56) References Cited

U.S. PATENT DOCUMENTS

| | | | |
|---|---|---|---|
| 2008/0169658 | A1 | 7/2008 | Wolf |
| 2010/0199726 | A1 | 8/2010 | Varney |
| 2010/0218425 | A1 | 9/2010 | Nolte |
| 2010/0263415 | A1 | 10/2010 | Rupsil |
| 2013/0214545 | A1 | 8/2013 | Wolf |
| 2013/0283695 | A1 | 10/2013 | Hollermann |
| 2016/0076282 | A1 | 3/2016 | Wolf |

FOREIGN PATENT DOCUMENTS

| | | | |
|---|---|---|---|
| GB | 2 461 107 | | 12/2009 |
| GB | 2 461 108 | | 12/2009 |
| JP | 2003041812 | A * | 2/2003 |

* cited by examiner

VENT STOP

CROSS REFERENCES TO RELATED APPLICATIONS

This application is a continuation-in-part of U.S. application Ser. No. 15/791,676, filed on Apr. 11, 2017, which is a continuation-in-part of U.S. application Ser. No. 15/484,295, filed on Apr. 11, 2017, which is a continuation of U.S. application Ser. No. 15/471,158, filed Mar. 28, 2017, which is a continuation of U.S. application Ser. No. 14/198,949, filed Mar. 6, 2014, now issued as U.S. Pat. No. 10,006,232, which is a continuation of U.S. application Ser. No. 12/658,642, filed Feb. 9, 2010, now issued as U.S. Pat. No. 8,833,809, which is a divisional of U.S. application Ser. No. 11/977,445, filed Oct. 24, 2007, now issued as U.S. Pat. No. 8,235,430, which is a continuation-in-part of U.S. application Ser. No. 11/390,467, filed Mar. 28, 2006, now issued as U.S. Pat. No. 7,530,611, all disclosures of which are incorporated herein by reference.

FIELD OF THE INVENTION

The present invention relates to improved window vent stops particularly for double hung windows and the like and to improvements in their operation. These window vent stops are used to prevent a window or door from opening more than a desired amount.

BACKGROUND OF THE INVENTION

There are a number of different types of window vent stops available on the market. An example of a window vent stop mechanism is shown in U.S. application Ser. No. 11/390,467, filed Mar. 28, 2007, the disclosures of which are herein incorporated herein by reference. These window vent stops are used to restrict the opening of windows and doors. For example, a window may be opened only a portion due to security concerns or to increase comfort in the room. Window vent stops are primarily used on double hung windows and sliding doors where a sash or a door member slides from a first position to a second position. The window sash lock prevents the sash or the sliding door from moving past a selected point. These sash locks can permit the window to be opened a desired amount for ventilation or other purposes.

There are many different types of windows currently available. These windows include casement windows, transom windows, single hung windows, double hung windows, sliding windows, etc. Double hung windows are windows that have a pair of window sashes that may be raised and lowered. Each sash resides in a pair of tracks or recesses that are typically at each side edge of the window. This permits the lower sash to be raised and the upper sash to be lowered. Traditionally, most windows were made of wood. More recently, the windows including the window sashes have been made of extruded metal or plastic.

Single hung windows are similar in design to double hung windows except that there is only one sash that may be raised or lowered. Sliding windows are also not unlike double hung windows in design. While a double hung window has sashes that are raised and lowered, a sliding window has sashes that are movable along a track to the right or left. Similarly, sliding doors operate the same way as sliding windows.

Double hung windows, single hung windows, sliding windows and sliding doors have a variety of open positions in which they may be placed. While a fully opened position can be desirable for ventilation purposes there can be a downside to the fully opened position. One downside is security. A fully open window or door, however, can be a location for unauthorized ingress and egress from the premises. For example, a double hung window that is opened wide can be a source of danger to small children who may climb up to the window. As a result, many municipalities have enacted laws requiring window guards. Additionally, an opened window or door can provide an invitation to third parties to gain access to the building. As a result, there are a number of vent stops that are available to secure a window or door having sliding members in a partially opened position.

One particular problem encountered, however, by users of window vent stops is that the installation becomes a difficult process. In order to install the window vent stop properly, a recess must be cut into the sash stile of the window. This recess must be wide enough to allow the vent stop's initial insertion into the recess, but it must also be snug enough that the vent stop will remain securely installed and able to serve its purpose of preventing the window from being opened wider than a specified distance. Problems occur when a mold of the window vent stop to be installed is used to carve the recess. At times due to mistakes by the person installing or the inaccuracies of the mold used to carve the recess, the recess cut into the sash stile is often not exactly a perfect fit for the vent stop, whether it be too large or too small. Therefore, a new vent stop must be purchased in these situations.

Another problem with the prior art vent stops, is that if a user wants a particular vent stop, that user must purchase a vent stop that is specifically fit for the sash stile thickness of that user's windows. If a user purchases and attempts to install a window vent stop that is either too big or too small for the sash stile in the window, that user must purchase a new window vent stop.

Thus, there is a need in the art for window vent stops with the ability to be used with sash stiles of various thicknesses and with recesses of variable sizes. This would save a user time and money in the installation of the window vent stop. The present invention fulfills this need by using flexible side engagement pieces which allow a particular vent stop to be installed in virtually any sash stile.

OBJECTS OF THE INVENTION

It is an object of the present invention to provide a vent stop that can be installed more easily than the prior art vent stops.

It is another object of the present invention to provide an improved vent stop that is more dependable in its operation than the prior art vent stops.

It is a further object of the present invention to provide a vent stop that provides a mechanism that permits the vent stop to be installed in a variety of different window types and sizes.

It is still another object of the present invention to provide a vent stop that is more flexible in its ability to fit into a variety of recesses carved into a sash stile.

It is still another object of the present invention to provide a vent stop that is more flexible in its ability to fit into a variety of recesses routed into a sash stile.

It is a still further object of the present invention to provide a vent stop that has flexible side engagement pieces which permit the vent stop to be installed in a variety of window types.

SUMMARY OF THE INVENTION

The present invention is directed to an improved vent stop or sash lock for use in a sliding sash window assembly or a sliding door assembly. The window may have one or more sashes usually upper and lower sash window frames installed for vertical sliding movement.

Alternatively, the window may have left and right horizontal sliding sashes. The door may also have one or more sliding doors. One sash frame or sliding door frame has a recess into the interior thereof. The vent stop has a housing adapted to be disposed in the recess.

This housing includes a cavity, usually with a bottom plate therein. Inside the cavity is a tumbler that may be in a retracted position and an extended position. When the tumbler is in an extended position the tumbler has a protruding apex at the top. The apex prevents a sash or door from moving when the apex contacts the sash or the door. The tumbler has at least one pivot means for pivotally securing said tumbler to said housing for movement between the extended position and the retracted position. In the extended position the bottom of the tumbler overlies a portion of the second sash to prevent movement of the lower sash past the tumbler. When in a retracted position within said cavity the sash or door can be raised and/or moved past the tumbler without interference. Also within the housing is a spring means for biasing said tumbler into the extended position. The tumbler has at least one means for retaining the tumbler within the housing. The retaining means may be one or more pins that extend laterally from the side of the tumbler and ride within an opening in the sidewall of the housing. Alternatively, the interior wall of the housing may have one or more pins extending toward the tumbler and riding within an opening in the tumbler's side wall.

The housing also has at least one side engagement piece, preferably two, which is preferably made from the same type of material as the housing and is flexible and bendable with the shape of the recess cut into the sash stile into which the window vent stop is placed. These side engagement pieces are intended to aid in the installation of the window vent stop into the sash stile and are flexible so as to enable the installation of the window vent stop in a wide variety of sash stiles of different sizes.

DETAILED DESCRIPTION OF THE PRESENT INVENTION

Figure 1:
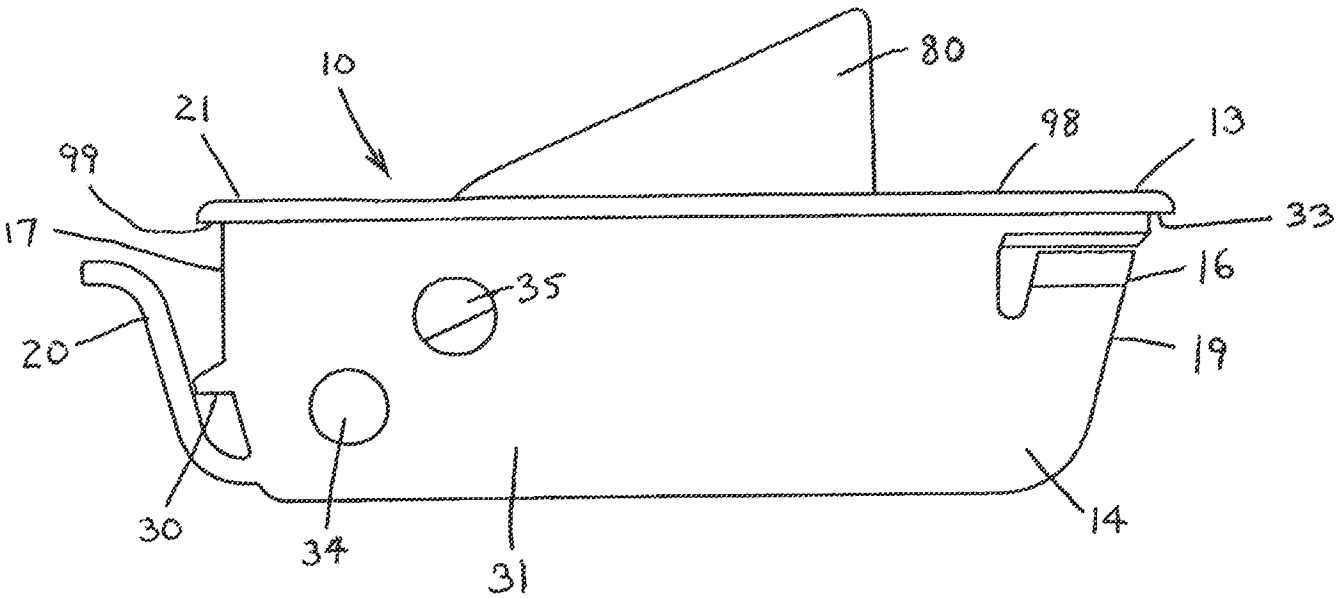
FIG. 1 is a side view of a preferred embodiment of the vent stop of the present invention with the tumbler in the extended position.

As used throughout this specification, the word "may" is used in a permissive sense (i.e., meaning having the potential to), rather than the mandatory sense (i.e., meaning must). Similarly, the words "include", "including", and "includes" mean including but not limited to.

The phrases "at least one", "one or more", and "and/or" are open-ended expressions that are both conjunctive and disjunctive in operation. For example, each of the expressions "at least one of A, B and C", "one or more of A, B, and C", and "A, B and/or C" mean all of the following possible combinations: A alone; or B alone; or C alone; or A and B together; or A and C together; or B and C together; or A. B and C together.

Also, the disclosures of all patents, published patent applications, and non-patent literature cited within this document are incorporated herein in their entirety by reference. However, it is noted that citing herein of any patents, published patent applications, and non-patent literature is not an admission as to any of those references constituting prior art with respect to the present invention Furthermore, the described features, advantages, and characteristics of any particular embodiment disclosed herein, may be combined in any suitable manner with any of the other embodiments disclosed herein.

Additionally, any approximating language, as used herein throughout the specification and claims, may be applied to modify any quantitative or qualitative representation that could permissibly vary without resulting in a change in the basic function to which it is related. Accordingly, a value modified by a term such as "about" is not to be limited to the precise value specified, and may include values that differ from the specified value in accordance with applicable case law. Also, in at least some instances, a numerical difference provided by the approximating language may correspond to the precision of an instrument that may be used for measuring the value. A numerical difference provided by the approximating language may also correspond to a manufacturing tolerance associated with production of the aspect/feature being quantified. Furthermore, a numerical difference provided by the approximating language may also correspond to an overall tolerance for the aspect/feature that may be derived from variations resulting from a stack up (i.e., the sum) of multiple individual tolerances.

It is further noted that any use herein of relative terms such as "top," "bottom," "upper," "lower." "vertical." "horizontal," etc. are merely intended to be descriptive for the reader, based on the depiction of those features within the figures for one particular position of the device, and such terms are not intended to limit the orientation with which the device of the present invention may be utilized.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 5:
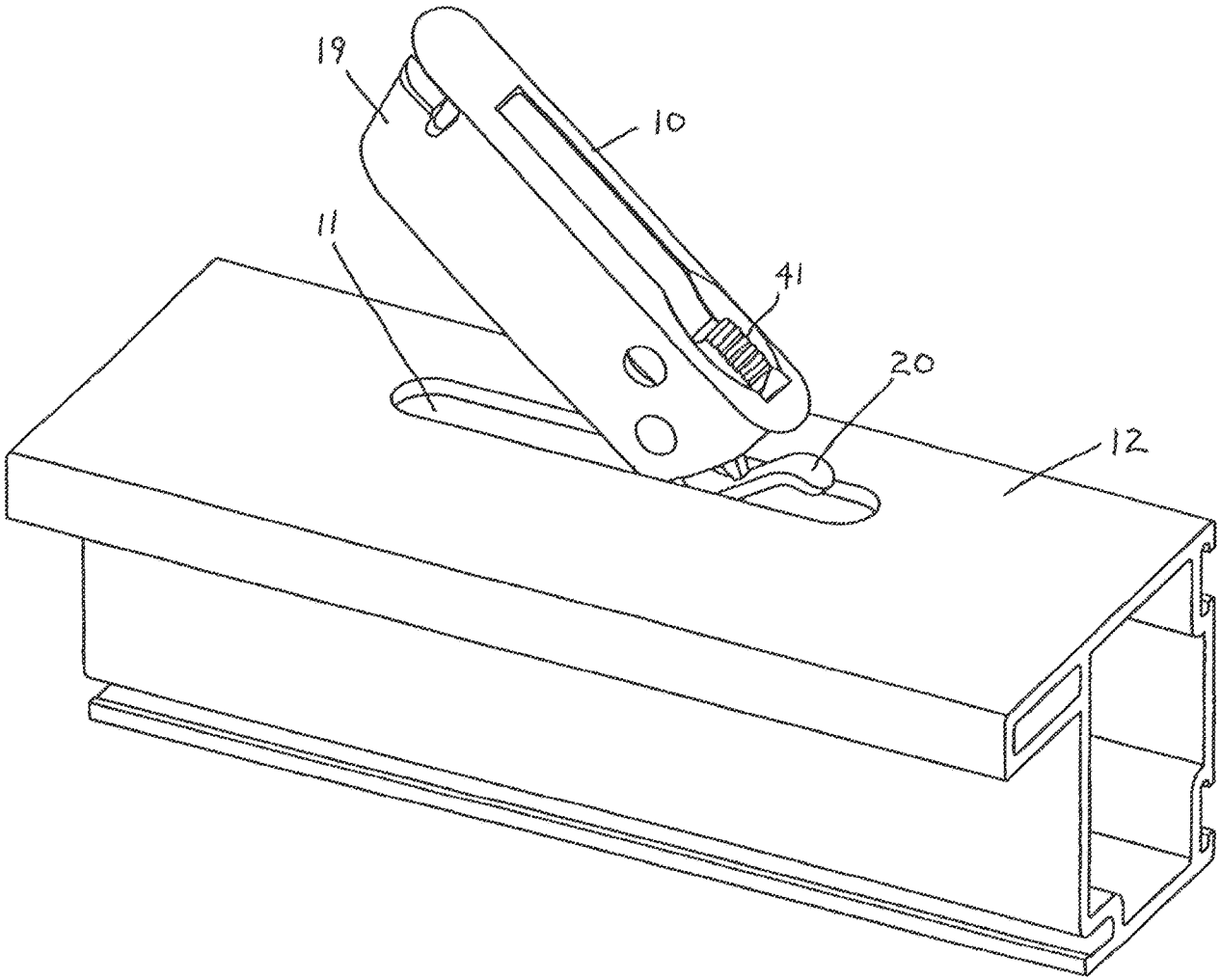
FIG. 5 is a top perspective view of the vent stop of FIG. 1 positioned over a slot in a window or door sash.
Figure 8:
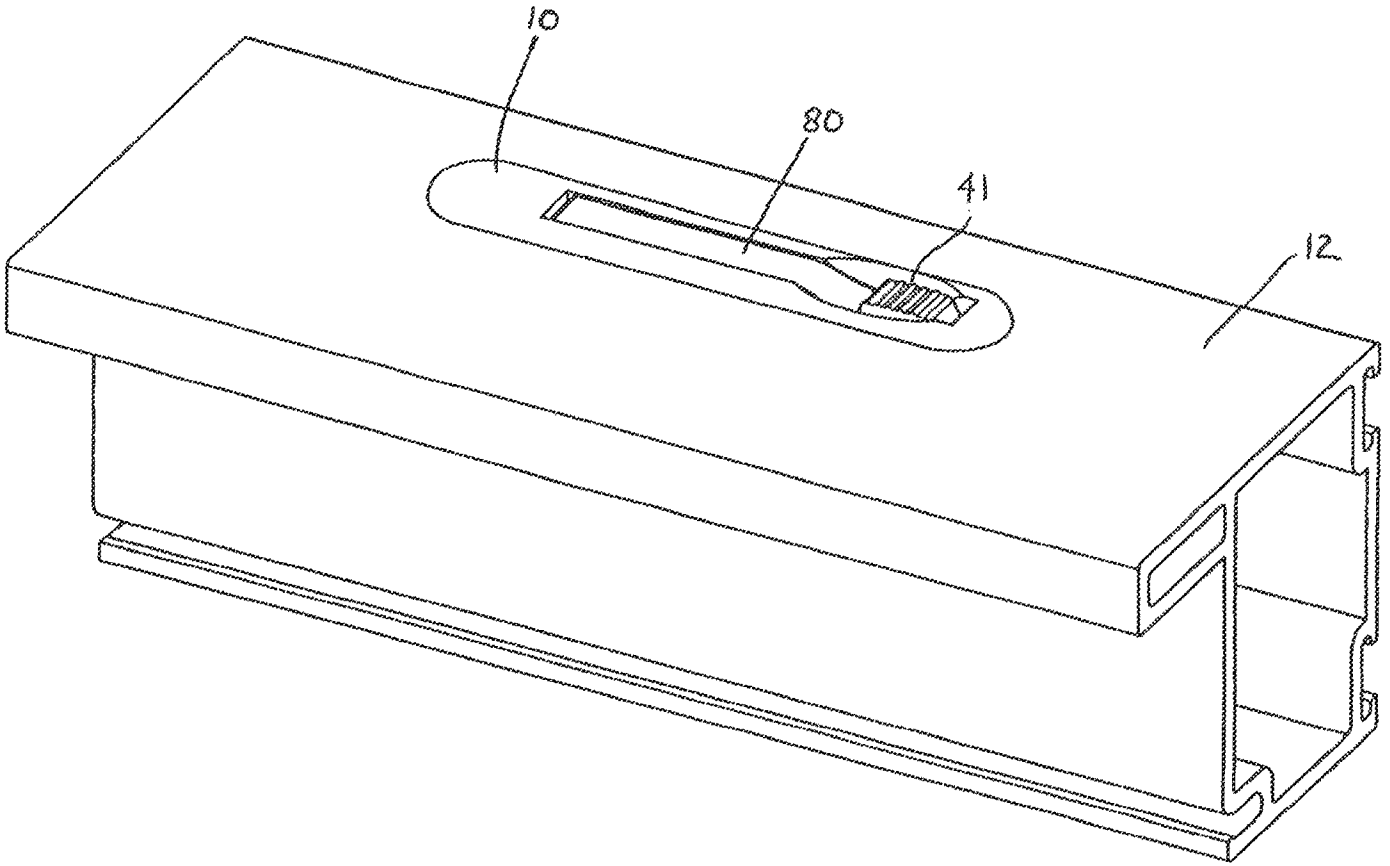
FIG. 8 is a top perspective view of the vent stop of FIG. 1 fully installed in a window or door sash.
Figure 9:
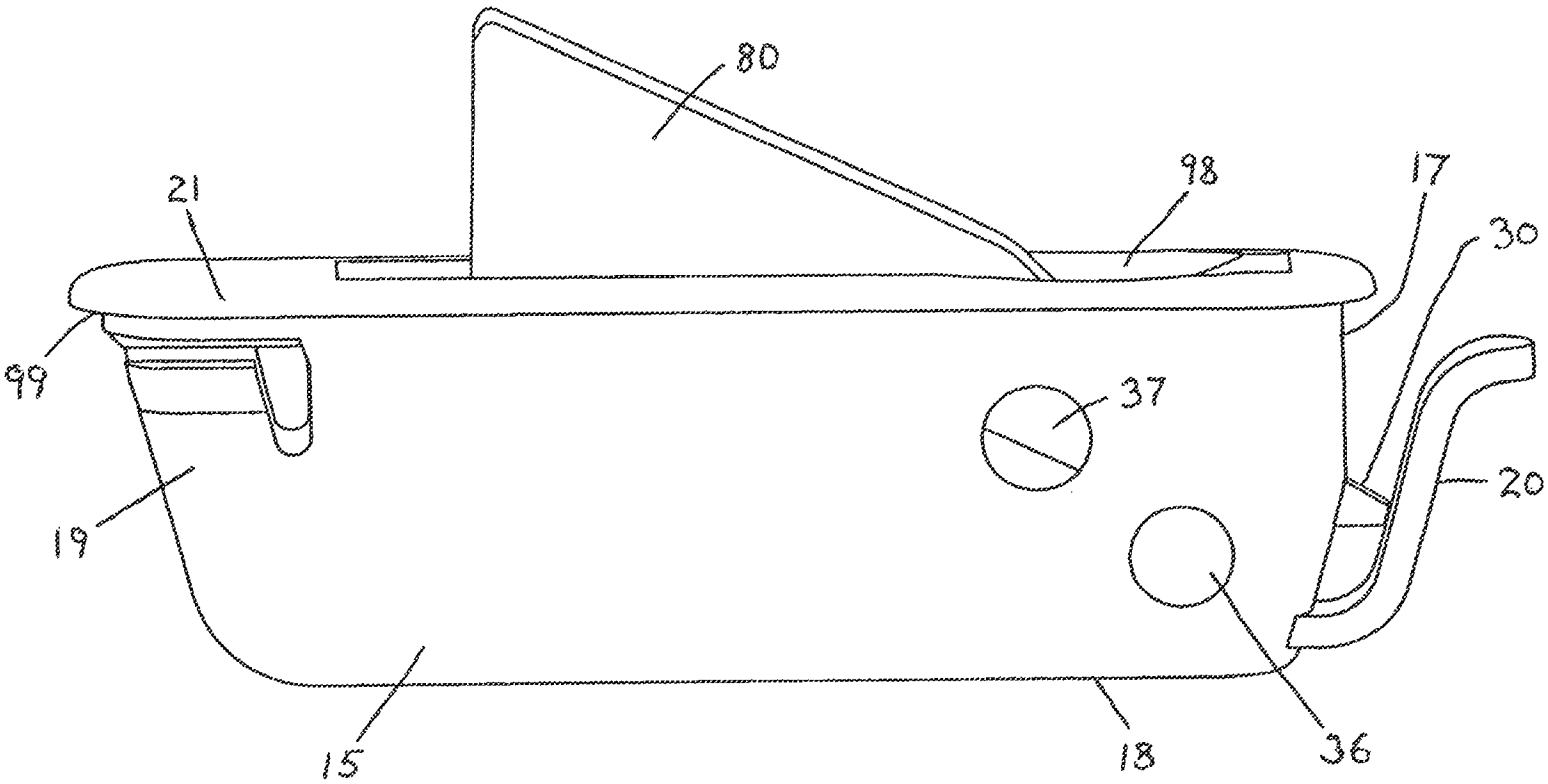
FIG. 9 is a top side perspective view of the vent stop of FIG. 1.
Figure 10:
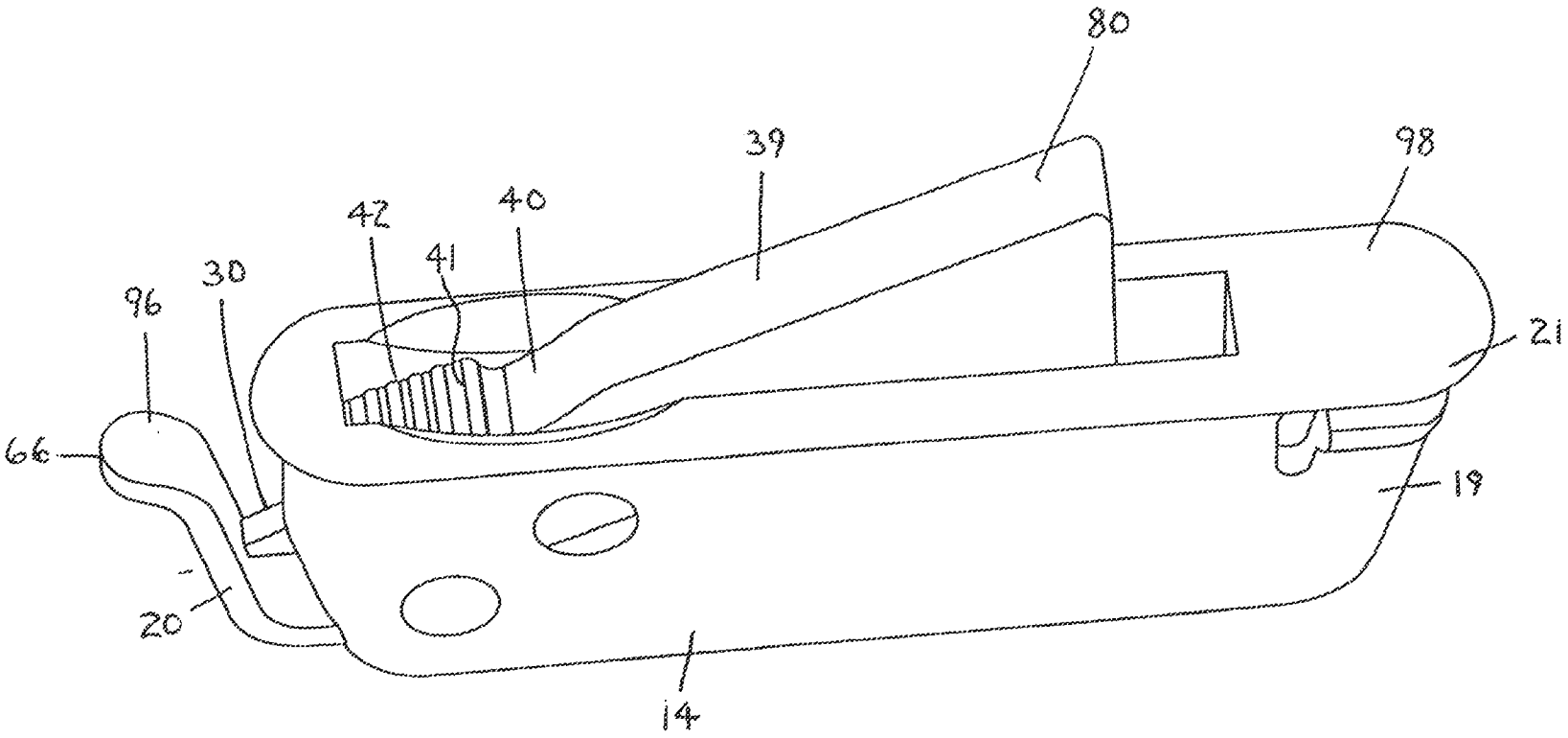
FIG. 10 is a top perspective view of the vent stop of FIG. 1 with the tumbler in the extended position.

In FIG. 1 the window vent stop of the present invention is shown generally at 10. The vent stop 10 is shown positioned over slot 11 in sliding member, such as a window or door sash 12 as seen in FIG. 5. The slot 11 is shown as having an oval shape, but any other suitable shape and size slots including but not limited to a square, rectangle, oval, etc. can be used depending on the shape of the latch. Preferably, however, the vent stop 10 of the present invention will have a portion similarly shaped to the slot 11 as to present a clean appearance when placed in the window sash 12, as seen in FIG. 8. In the present embodiment an oval shape for illustration purposes was used. The window sash can be a sash, doorframe, or any other member that has another piece sliding over it, where restriction of the window sash is desired. The tumbler 80 can be either in a raised or lowered position. When raised it prevents movement of the door or sash, as seen in FIG. 1.

Figure 4:
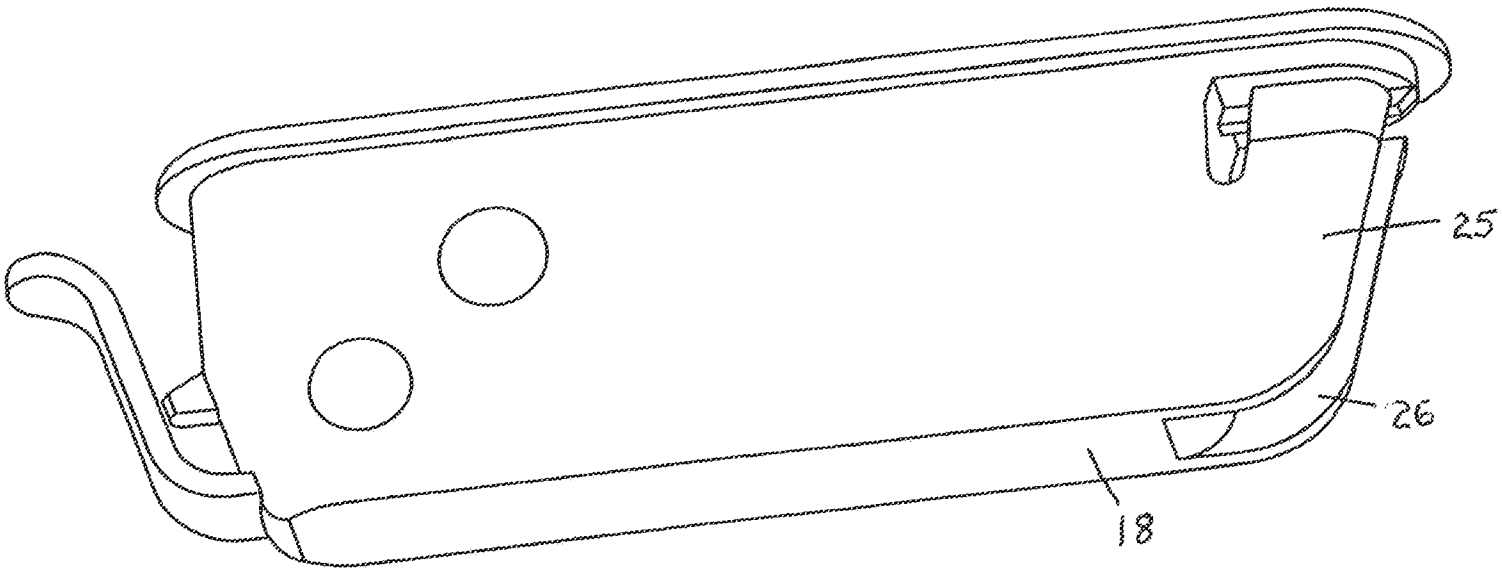
FIG. 4 is a side bottom perspective view of the vent stop of FIG. 1 with the tumbler in the retracted position.
Figure 15:
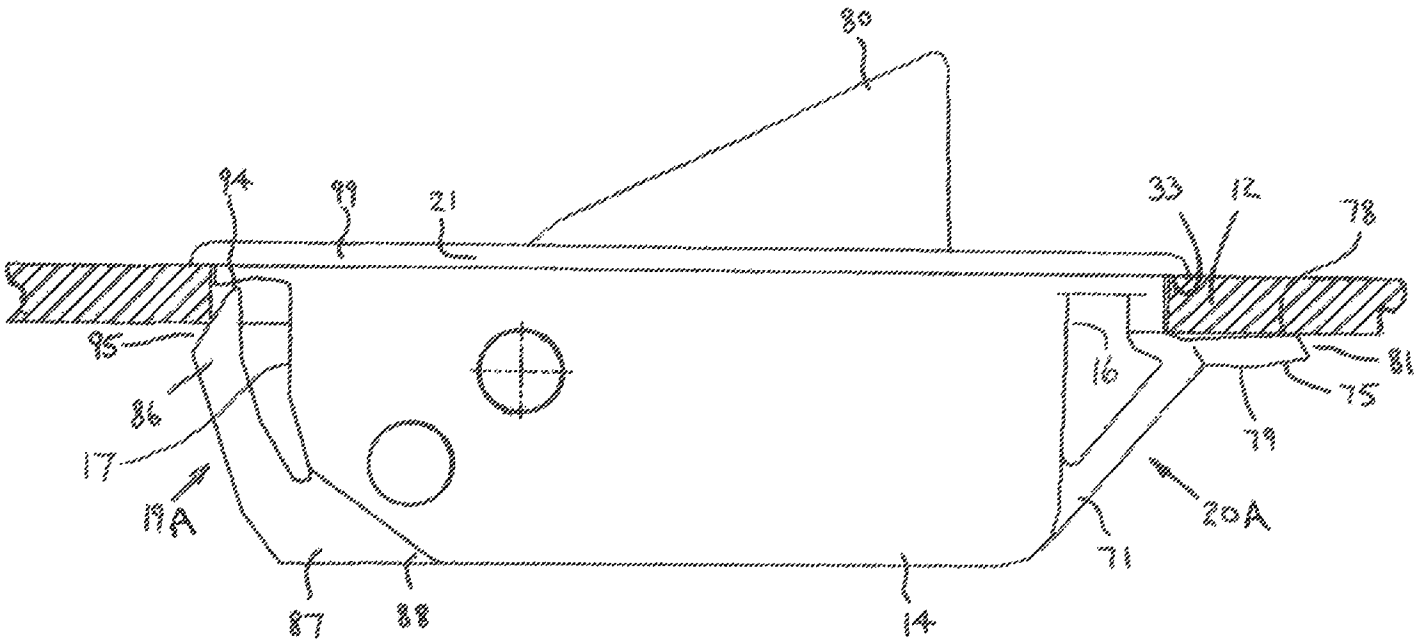
FIG. 15 is a side cross-sectional view of the vent stop of FIG. 14 installed in a sash stile of a greater thickness.
Figure 21:
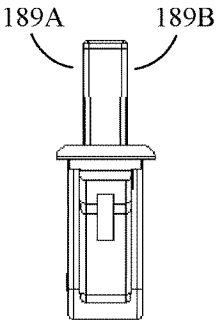
FIG. 21 is a second end view of the vent stop of FIG. 16.
Figure 19:
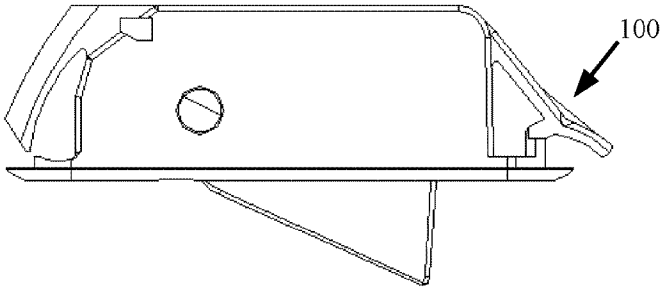
FIG. 19 is a second side view of the vent stop of FIG. 16.
Figure 18:
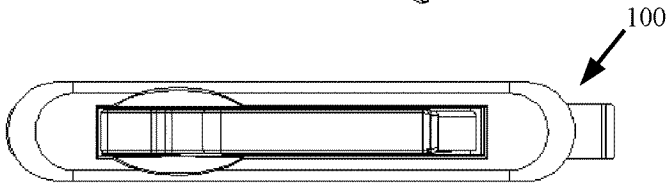
FIG. 18 is a top view of the vent stop of FIG. 16.

A housing 13 is generally defined by a first sidewall 14, a second sidewall 15, a front wall 16, a rear wall 17, and a bottom wall 18, as shown in FIG. 4. Bottom wall 18 can also serve as a cover. In the present embodiment however bottom wall 18 is sealed, and no cover is present. It is noted that the terms "front" and "rear" are used only for descriptive purposes and do not read on orientation of the device. Sidewalls 14, as seen in FIGS. 1 and 15, are preferably the same length, as are front and rear walls 16 and 17, respectively, providing for a generally rectangular shape to housing 13. Preferably, when in place within slot 11, sidewalls 14 and 15 contact the edges of slot 11 to provide for a tight fit, and prevent a lateral movement of the vent stop 10 within slot 11. There is also a top plate 21 has a top surface 98 and an underside 99, and extends outwardly past the edge of the front and rear walls 16 and 17, creating a lip 33, as seen in FIG. 1. Front wall 16 and rear wall 17 can each have a flexible clip 19 and 20. In one embodiment of the present invention, there is only one flexible clip, first flexible clip 19. However, in the preferred embodiments, there are two clips, first flexible clip 19 and second flexible clip 20. The flexible clips 19 and 20 are preferably not identical, although, in alternate embodiments, they can be identical.

Figure 2:
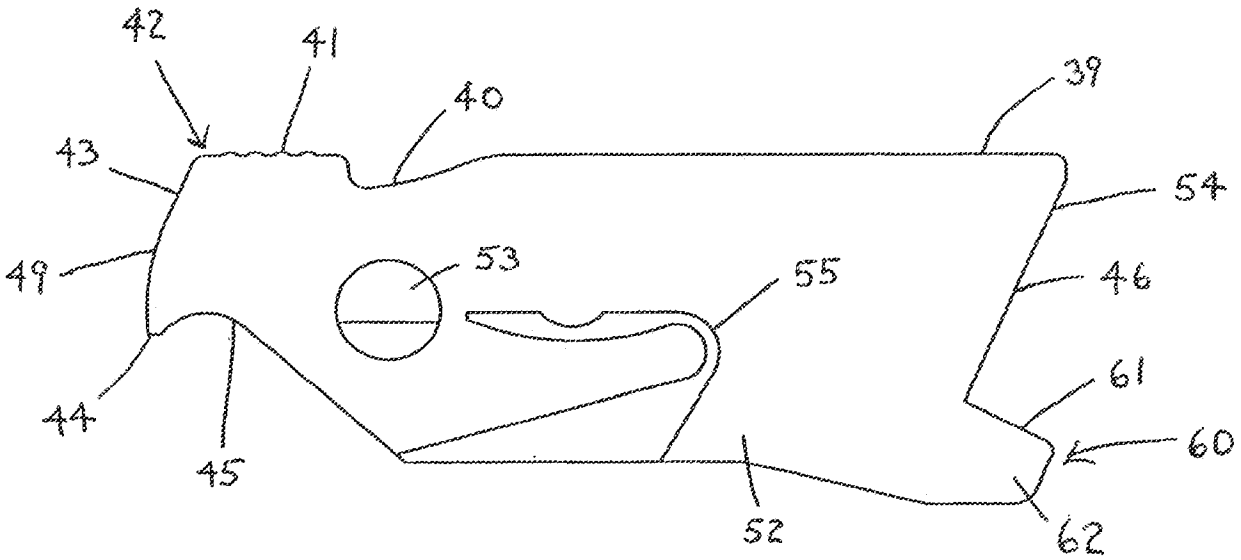
FIG. 2 is a side view of the tumbler of the vent stop of the present invention.
Figure 3:
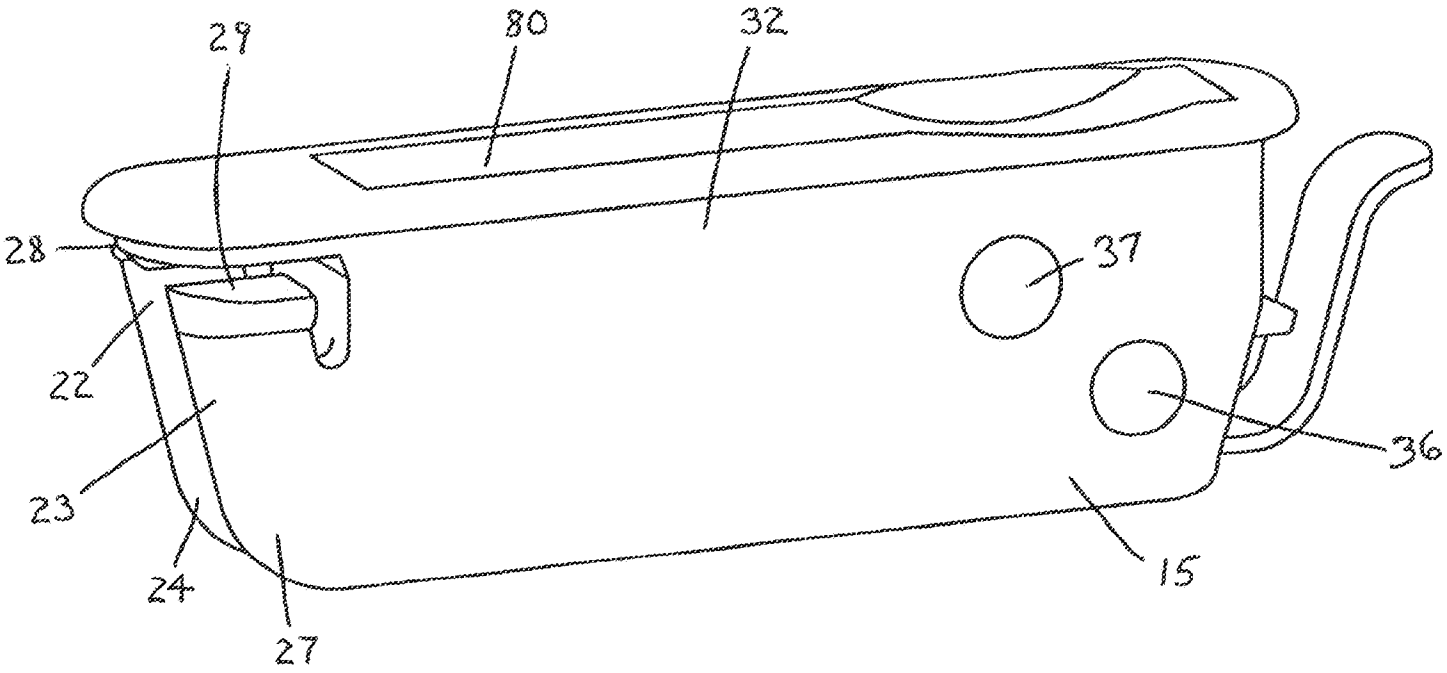
FIG. 3 is a side top perspective view of the vent stop of FIG. 1 with the tumbler in the retracted position.

Either flexible clip 19 or 20 can be attached to either front wall 16 or rear wall 17 depending upon a user's preference. As such it should be appreciated, that the embodiments illustrated in FIGS. 1-16 could easily be reversed and the first and second flexible clips 19 and 20 could be on the opposite wall 16 or 17. In one embodiment, illustrated in FIGS. 1-10, first flexible clip 19 can extend generally in an upward fashion, originating at or near the bottom surface 18 of housing 13 and ending typically just below top plate 21, as seen in FIG. 1. In addition, flexible clip 19 may be solid or hollow. In one preferred embodiment, flexible clip 19 may split and be comprised of two generally rectangular protrusions, so as to resemble two teeth, a first "tooth" 22 and a second "tooth" 23, as seen in FIG. 3, located on sidewalls 14 and 15. The first tooth 22 may have inner and outer surfaces, including inner surface 24, as seen in FIG. 3, and outer surface 25, as seen in FIG. 4, located adjacent to sidewall 14. The second tooth 23 may also have inner and outer surfaces, including inner surface 26, as seen in FIG. 4, and outer surface 27, as seen in FIG. 3, located adjacent to sidewall 15. Flexible clip 19 may be affixed to front wall 16 or flexible clip 19 may be an integral part of housing 13, in the present embodiment flexible clip 19 is an integral part of housing 13. In addition, flexible clip 19 has top surfaces 28 and 29, located on teeth 22 and 23 respectively.

Figure 6:
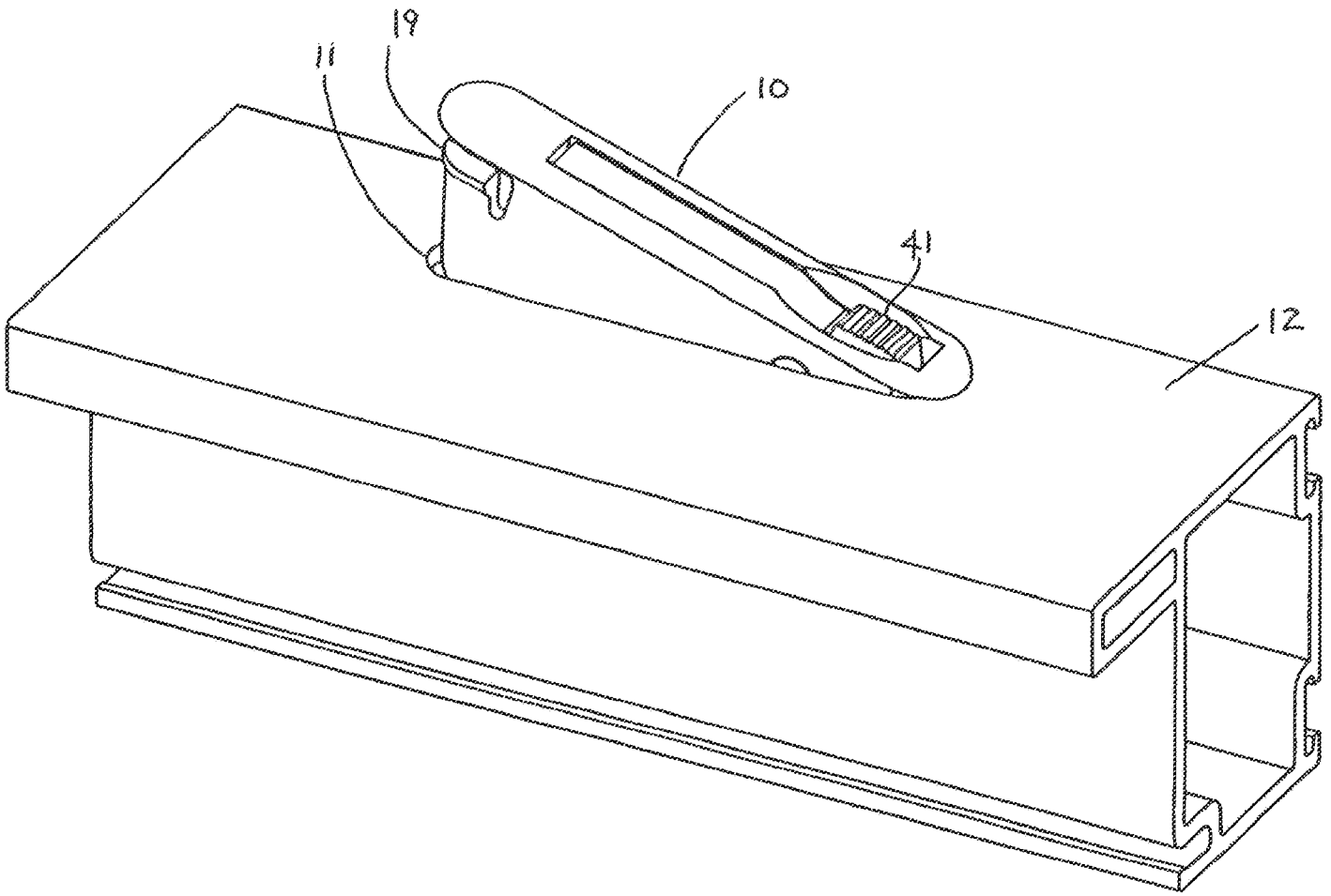
FIG. 6 is a top perspective view of the vent stop of FIG. 1 partially installed in a slot in a window or door sash.
Figure 13:
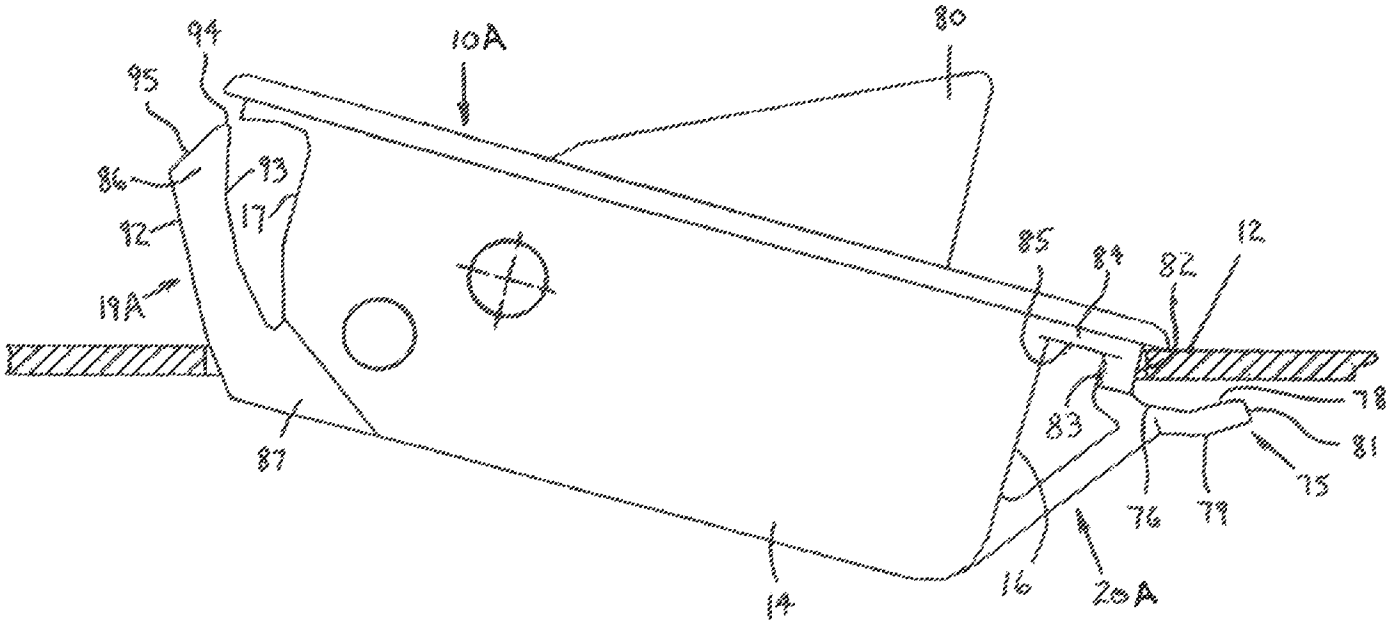
FIG. 13 is a side cross-sectional view of the vent stop of FIG. 11 as it is being installed into a window sash stile.

The second clip 20 ideally has more flexibility than the first clip 19, as seen in FIG. 1, and is adapted to grip the window sash 12 when a user attempts to install the vent stop, as shown in FIGS. 6 and 13. It may be located at the end of the housing 13. In this embodiment, the vent stop of the present invention can be more compatible with different style doorframes. For greater ease of installation, there is a tab 30 protruding from rear wall 17 of housing 13 as seen in FIG. 1, which ensures enough space between the clip and the housing 13. When the vent stop 10 is depressed into slot 11 on a window sash 12, the second flexible clip 20 should be inserted sideling into slot 11 as seen in FIGS. 6 and 13. Flexible clips 19 and 20 can engage a portion of the window sash 12, as seen in FIG. 6. This engagement can prevent vertical (front and back) movement of the vent stop 10 within the window sash 12, as well as preventing the vent stop 10 from being easily dislodged from slot 11.

Figure 7:
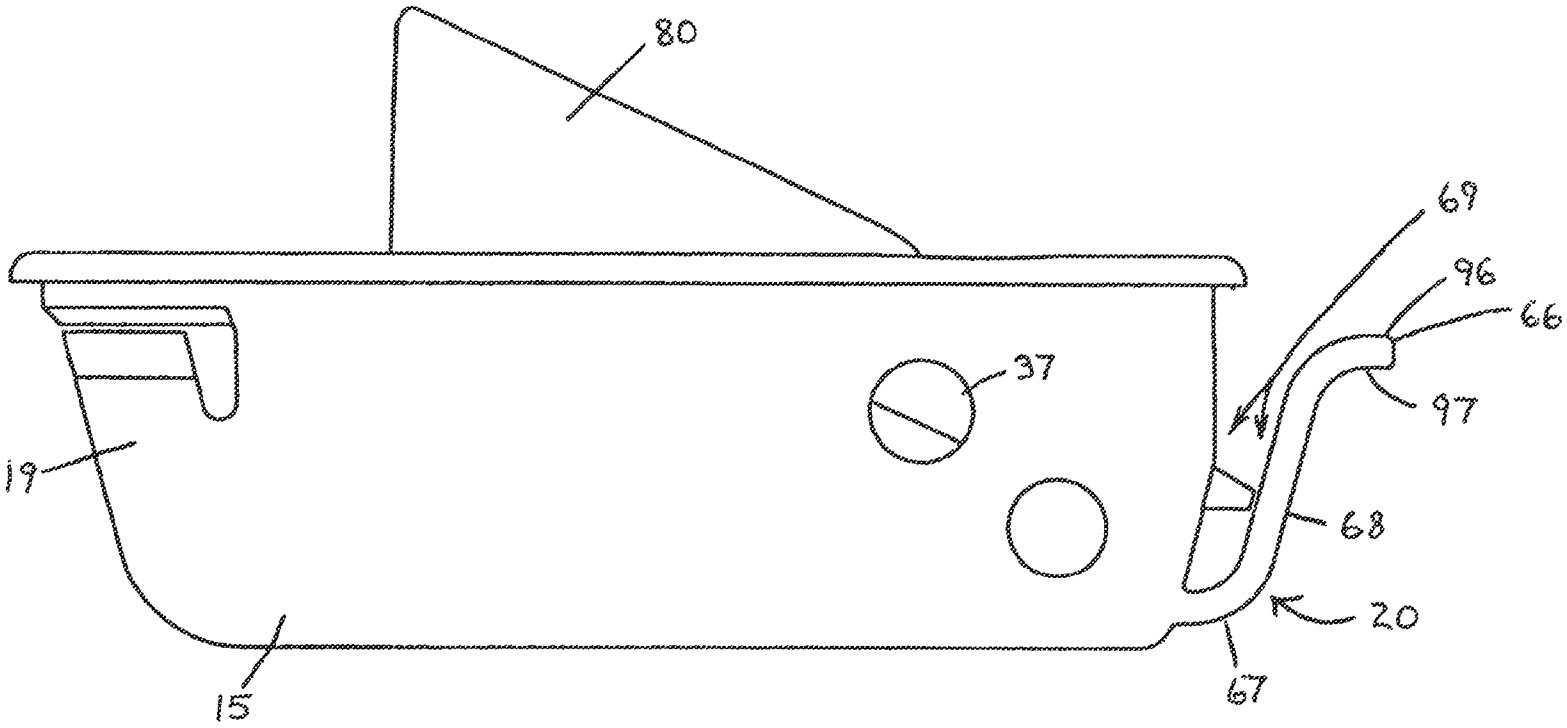
FIG. 7 is a side view of the vent stop of FIG. 1 showing the side opposite the one shown in FIG. 1.

The shapes that second clip 20 could have are virtually endless, so long as the clip 20 maintains its flexibility while still possessing the ability to grip the window sash 12, to provide a clean installation of the vent stop 10. However, in one embodiment, the second clip 20 preferably is "S"-shaped, characterized by curved upper and lower portions 66 and 67, each connected by a generally flat center portion 68, as shown in FIG. 7. In this embodiment, the lower portion 67 of the second clip 20 preferably is connected to the rear wall 17 of the housing 13; nevertheless, the clip 20 could be secured to the housing 13 at any feasible point along the rear wall 17. The lower portion 67 of the second clip 20 is arcuate, curving upward toward the flat center portion 68, creating an S-shaped clip, that strongly resembles the appearance of the "integral" sign in calculus. However, the bottom portion 67 could be curved in an opposite manner, or could even be flat, at an angle to the center portion 68 of the clip 20 in alternate embodiments. In another alternate embodiment, the second clip 20 does not even have a lower portion and the center portion 68 extends diagonally outwardly from the rear wall 17 of the housing 13. The center portion 68 of the second clip 20 extends diagonally outwardly from the lower portion 67, creating a gap 69 between it and the rear wall 17. This gap 69 allows the clip 20 to bend inwardly upon the installation of the vent stop 10. In alternate embodiments, however, the center portion 68 may extend straight in an upward direction from the lower portion 67 rather than outwardly. In other embodiments, the center portion 68 may be more S-shaped, with a portion that extends outwardly from the lower portion 67 and then inwardly toward the rear wall 17. Alternatively the distance the clip 20 maintains between it and the rear wall 17 may be adjustable based on the desired flexibility. The upper portion 66 of the second clip 20 is a generally curved piece, arced in the opposite direction of the lower portion 68. But, in alternate embodiments it may be curved in a different direction, such as upward. The upper portion has top and bottom surfaces 96 and 97. The top surface 96 of the upper portion 66 is where the window sash or other window sash 12 may rest when the vent stop is secured. The top surface 96 of the upper portion 66 of the second clip 20, along with the underside of the lip 33 of the top plate 21, act as a gripping mechanism holding the window sash in place. Although the upper portion 66 is generally short, equal in length to the lower portion 67, it may be longer or shorter as desired.

Figure 11:
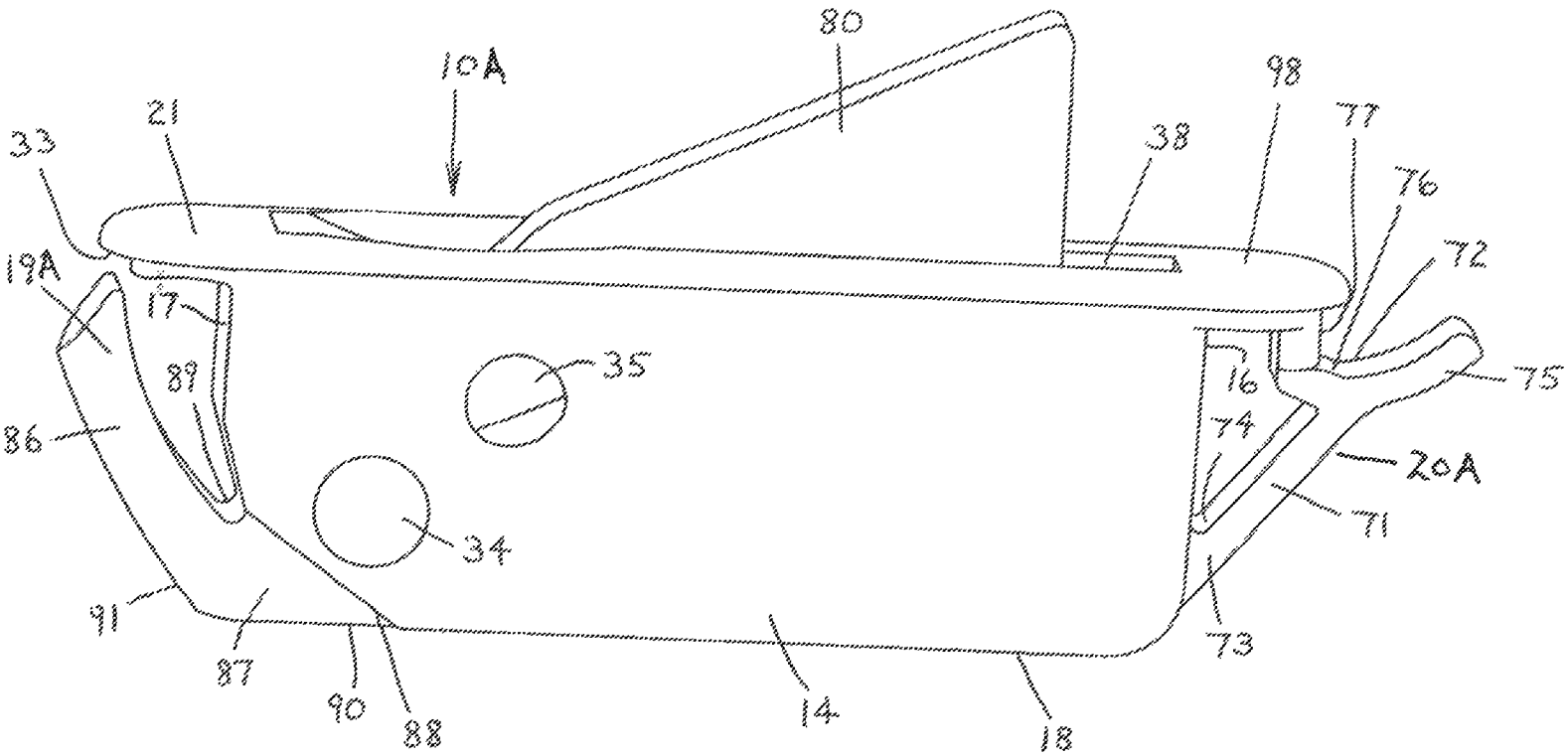
FIG. 11 is a side view of a preferred embodiment of the vent stop of the present invention different from the embodiment in FIGS. 1-10.
Figure 14:
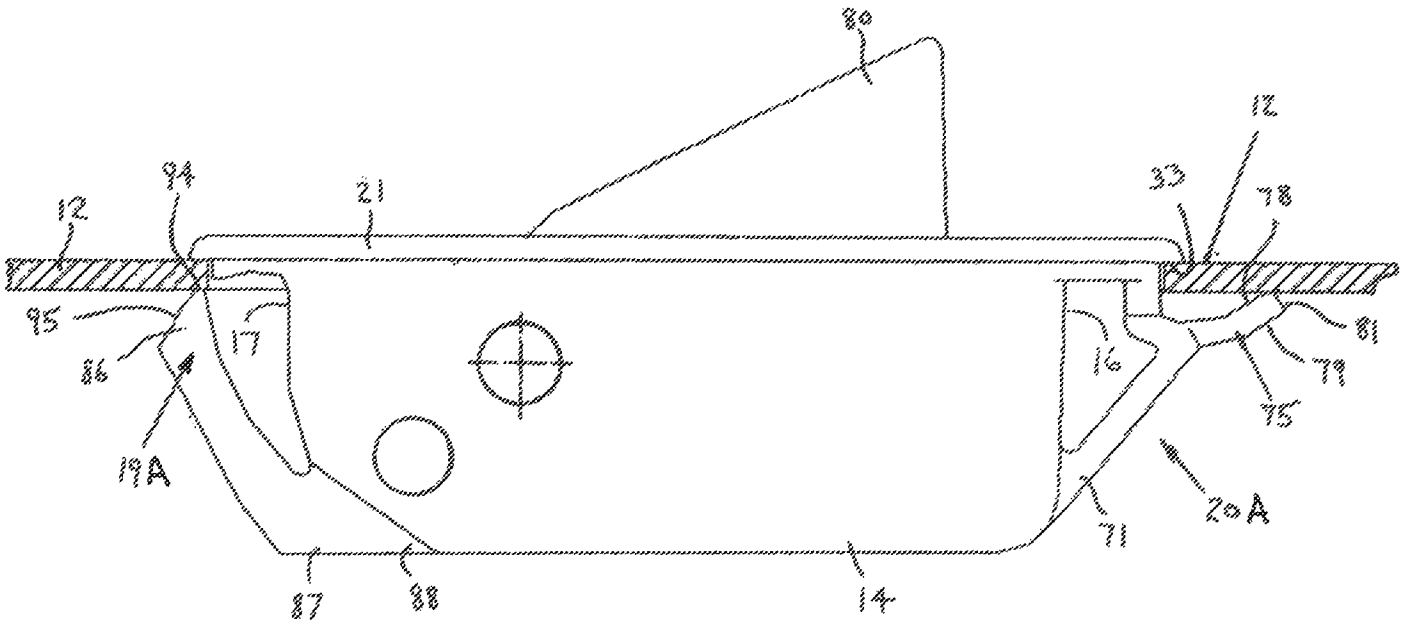
FIG. 14 is a side cross-sectional view of the vent stop of FIG. 13 after it has been installed in the sash stile.

In another preferred embodiment, shown in FIGS. 11-15, the first clip 19 has only one protrusion 86, which extends outwardly from the rear wall 17 of the housing 13. This embodiment of the first clip, is characterized by a protruding arm 86 and a base portion 87 connected to a recessed wall 88 situated between the rear wall 17 and the bottom wall 18 of the housing 13, as shown in FIG. 11. The base portion has top and bottom surfaces 89 and 90 respectively, as well as a rear surface 91, which are all generally flat. Extending from the base portion 87 of the first clip 19 is a single protruding arm 86, which is flexible and is at an angle with the rear wall 17. The arm 86 is generally rectangular, with an inner surface 92, an outer surface 93, a pointed upper surface 94 and a flat side surface 95, as shown in FIG. 13. When the vent stop is slid into the slot 11 in the window sash 12, this embodiment of the first clip will bend inwardly toward the rear wall 17, until the vent stop fits inside the slot. Once the vent stop 10 has been inserted, the protruding arm 86 will release back to its old position further away from the rear wall 17, with the window sash 12 being secured between the pointed upper surface 94 of the first clip 19 and the lip 33 of the top plate 21, as shown in FIG. 14. In alternate embodiments, the shape of the first clip may be changed. For instance, the upper surface 94 does not have to be pointed, and the arm 86 can attach to the housing 13 at a different point along the rear wall 17. Additionally, a raised member, or tab could extend outwardly from the rear wall 17 so as to limit the amount of room the arm 86 has to move inward toward the rear wall 17. Essentially, any embodiment practicable to one in the art that would achieve the flexible support described above is possible.

Another preferred embodiment of the second clip 20 of the vent stop 10 of the present invention can also be seen in FIGS. 11-15. In this embodiment, the second clip 20 comprises an arm 71 and a gripping mechanism 72, as shown in FIG. 11. The arm 71 generally has a base portion 73 that extends outwardly from the front wall 16, so that the arm 71 is diagonal to the surface of the front wall 16. In the present embodiment, this base portion 73 is generally characterized by a flat upper surface 74, and a bottom surface which is indistinguishable from the rest of the arm 71, as shown in FIG. 11. In alternate embodiments, the base portion 73 may be longer or curved, much like the lower portion 67 of the S-shaped clip 20 shown in FIGS. 1-10. The arm 71 is generally fat, although, in alternate embodiments, it may be curved as so desired. Extending from the top of the side opposite the base portion 73 of the arm 71 is the gripping mechanism 72 of the second clip.

The gripping mechanism 72 comprises a protruding hook 75, a flat support surface 76 and a vertical retaining block 77. The protruding hook 75 extends outwardly from the top of the arm 71 of the second clip 20, so that the hook may catch the window sash 12 and secure the vent stop 10 to the sash. The hook 75 is generally curved upward and has top and bottom surfaces 78 and 79 as well as a front surface 81, as shown in FIG. 13. The window sash generally comes into contact with the top surface 78, where it comes to rest securely upon installation, as shown in FIG. 14. Although the hook 75 is generally curved, it could be flat in another embodiment, as the user desires. It may be curved in the opposite direction in another embodiment. The hook 75 is connected directly to a flat support surface 76, as shown in FIG. 11, the purpose of which is to further secure the window sash 12 to the vent stop 10. The support surface 76 comes into contact with a vertical retaining block 77, which has a front end 82 and a rear end 83, as shown in FIG. 13. This retaining block 77 extends upwardly to the lip 33 of the top plate 21 on the rear end 83, and upwardly toward the underside 85 of an inner flange 84 running parallel to the top plate 21. The retaining block 77 further locks the window sash 12 in place in the clip 20. In various alternate embodiments, each of the various pieces 75, 76, and 77 of the gripping mechanism 72 may be removed. For instance, one embodiment might utilize the hook 75 and the support surface 76, but not the retaining block 77. Any arrangement that would safely secure the window sash 12 within the grip of the clip 20 that is practicable to one knowledgeable in the art is possible.

In alternate embodiments not yet illustrated a variety of configurations of clips 19 and 20 can be utilized. For instance, since the second clip 20 requires only a gripping mechanism for holding the window sash 12 in place while the vent stop 10 is installed, any practicable gripping mechanism may be utilized. One example would be to utilize two protrusions extending outward from the wall of the housing, with no clip extending upward. One protrusion will fit underneath the window sash 12 and, the other, above it. For the first clip 19, in order to facilitate installation, the clip 19, as seen in FIGS. 11-15 could be concaved on both sides, creating an easier installation into the slot 11 and more flexibility. A final example of an alternate embodiment is if the clips 19 and 20 were on the sidewalls 14 and 15 of the housing 11 rather than the front wall 16 and rear wall 17. In this way, the vent stop 10 could be secured to the window sash 12 in a different manner.

First sidewall 14 has an inner surface, not shown, and outer surface 31, as seen in FIG. 1. Second sidewall 15 has inner surface, not shown, and outer surface 32, as seen in FIG. 3. On sidewalls 14 and 15 there can be four apertures, apertures 34 and 35 on sidewall 14, as seen in FIG. 1, and apertures 36 and 37 on sidewall 15, as seen in FIG. 3. Apertures 34 and 36 of sidewalls 14 and 15, respectively, are aligned along the same central axis and are positioned towards rear wall 17, and are used to prevent tumbler 80 from rotating passed a predetermined area and to support a substantial upward force associated with the lifting of the lower sash against the stopping surface of the latch. Apertures 35 and 37 of sidewalls 14 and 15, respectively, are also aligned along the same central axis; these apertures are designed so as to allow tumbler 80 to rotate in an outwardly fashion. In another embodiment one could implement bored cavities, aligned in a similar fashion, instead of apertures.

In yet another embodiment, sidewalls 14 or 15 may have at least one rotation member extending there from. In this type of embodiment tumbler 80 would have apertures or bored cavities aligned along the same central axis so as to allow tumbler 80 to rotate in an outwardly fashion.

A lip 33 is attached to top plate 21 is preferably at least the same size or larger and the same general shape as slot 11. Thus, when vent stop 10 is placed into slot 11, lip 33 will contact at least the edges of slot 11 or over spread the upper surface of the window sash 12. These dimensional attributes will allow for a tight fit that will exhibit a finished smooth exterior, which can be aesthetically pleasing. Although top plate 21 is referred to as a "plate", it is understood that housing 13, clip 19, lip 33 and top plate 21 can be, integral pieces, without any need for adhesives or assemblage.

In the preferred embodiment second clip 20, attached to the rear of the housing, is preferably almost as high as the lower portion of the housing under the slot 11. Thus, when vent stop 10 is placed into slot 11, clip 20 will contact at least the edges of slot 11 or over spread, the upper surface of the window sash 12. These dimensional attributes will allow for a tight fit that will exhibit a finished smooth exterior, which can be aesthetically pleasing. Although top plate 21 is referred to as a "plate", it is understood that housing 13, clip 19, clip 20 and top plate 21 can be integral pieces, without any need for adhesives or assemblage.

Figure 12:
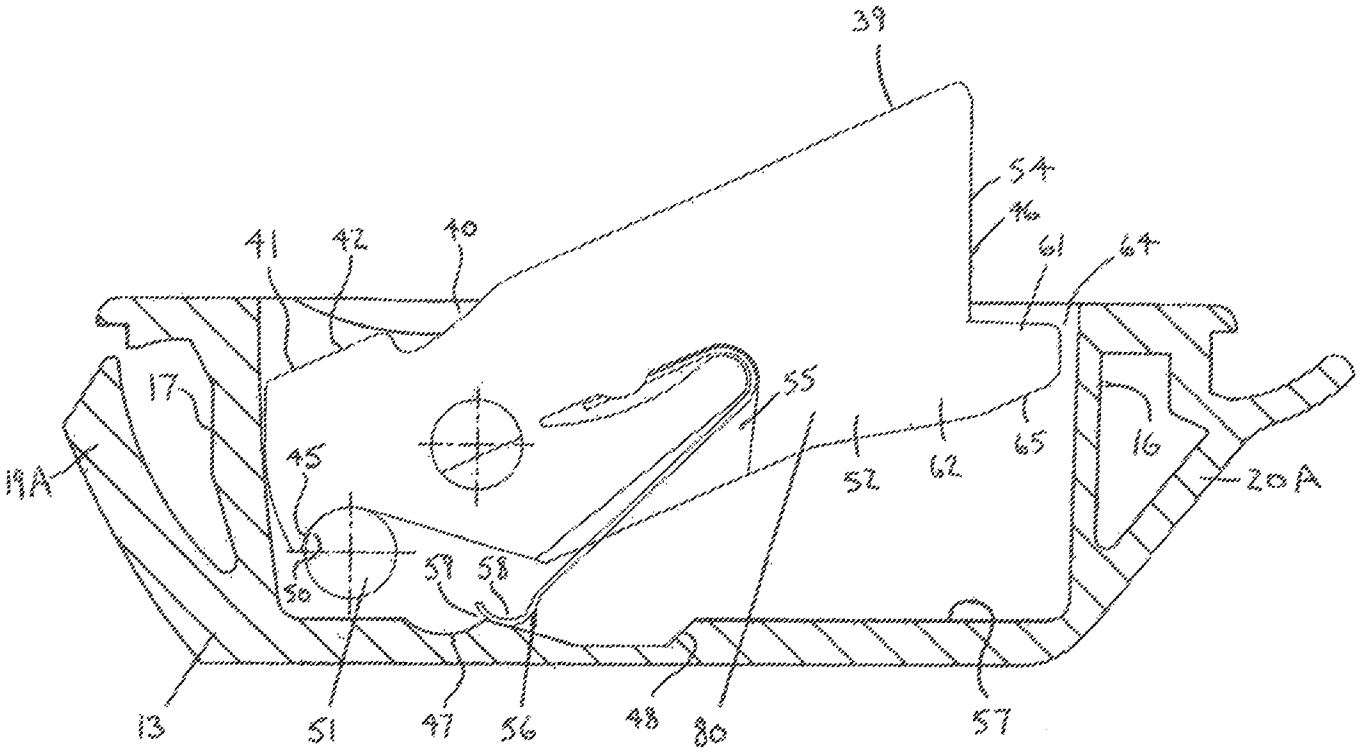
FIG. 12 is a cross-sectional view of the vent stop of FIG. 11.
Figure 12A:
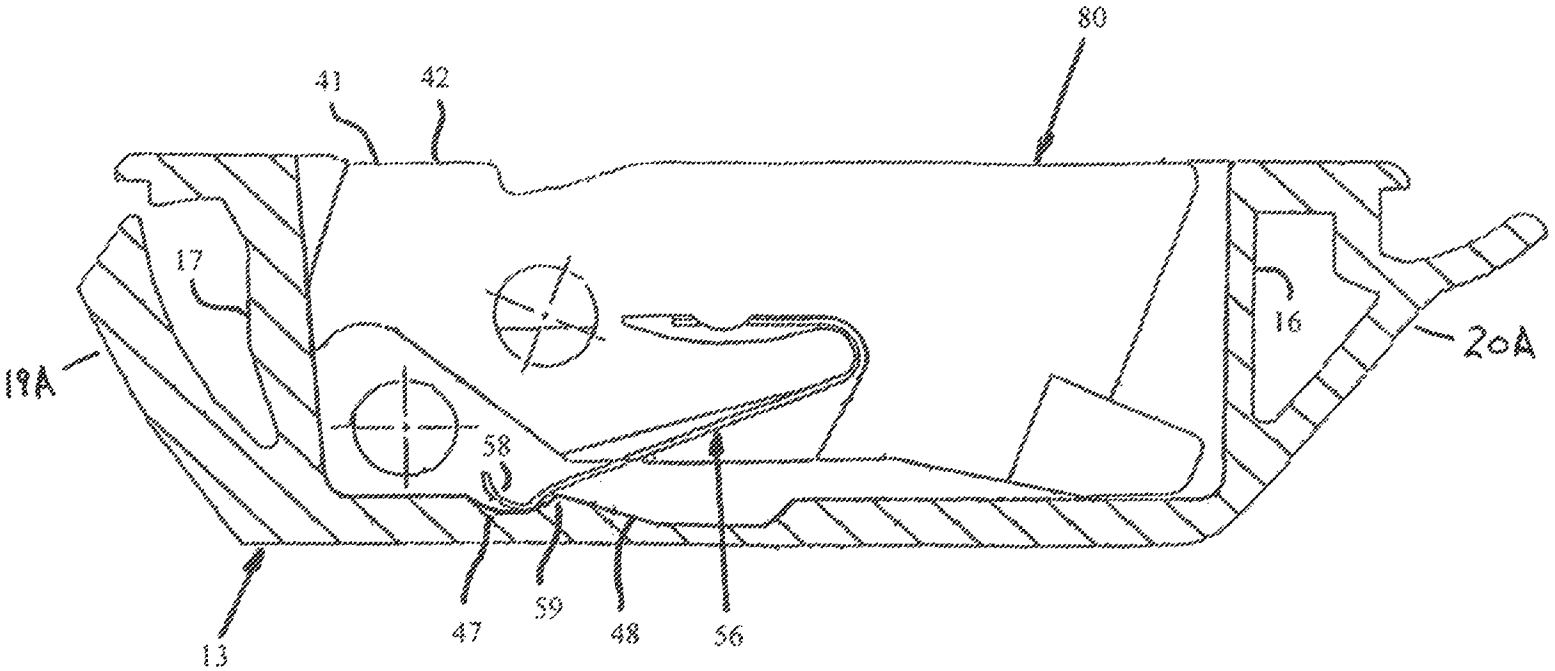
FIG. 12A is a cross-sectional view of the vent stop of FIG. 12, but with the tumbler shown in the retracted position.

A tumbler 80 is preferably designed to fit within cavity 38 of housing 13, as seen in FIG. 11. Tumbler 80 may have an upper surface 39, which is preferably smooth and/or flat on the front portion, as seen in FIG. 2. Where upper surface 39 is flat, it will exhibit a more finished look for the vent stop 10 when it is placed in window sash 12. Tumbler 80 may have an indent 40 located toward the rear top surface. In addition tumbler 80 may have a grooved top portion 41 located right above indent 40, as in the present invention, which may act as a button 42, so as to allow the user to activate tumbler 80. The rear edge 43 of tumbler 80 slopes downward and comes to a point 44, where rear edge 43 meets arcuate bottom portion 45. Tumbler 80 can have a front end 46 and a rear end 49, along with side surfaces 52. Tumbler 80 can have rotation members 53, which can fit in apertures 35 and 37, of sidewalls 14 and 15 respectively, of housing 13. The rotation members 53 can be located on side surfaces 52, respectively, close to rear end 49. Preferably, rotation members 53 are cylindrical pegs, which protrude from side surfaces 52 of tumbler 80, respectively. The rotation members 53 can allow tumbler 80 to extend outwardly, thus exposing front end face 54 of tumbler 80, which would prevent movement of window sash 12. The tumbler 80 will be allowed to rotate until arcuate surface 45 of tumbler 80 comes into contact with a surface 50 of peg 51, as seen in FIG. 12, and discussed hereinafter. The window vent stop may be constructed of any type of material known in the art, including, but not limited to plastic, metal, wood, etc., to be capable of withstanding the downward force imposed on the tumbler by the sash window. The peg may be any shape known in the art, including, but not limited to, a cylindrical peg, a rectangular block, or a square peg. In the present embodiment a plastic cylindrical peg was implemented. In addition, cylindrical peg 51 may be separate part or it may be an integral part of housing 13, however, in the present embodiment the cylindrical peg 51 is a separate member.

Tumbler 80 has a cavity 55 that houses the plate spring 56, as seen in FIGS. 2 and 12. However, this is not the only possible method of attaching a spring to tumbler 80. For example, tumbler 80 can have a protruding peg on either of the side surfaces 52 that could hold the plate spring 56 in place. If this type of spring configuration is implemented, then housing 13 would have to be of such dimensions so as to allow for the additional needed space. Tumbler cavity 55 has a top and bottom surface equal in width to plate spring 56 it houses. Plate spring 56 also has a rounded bottom portion that contacts the left arcuate nest 47 and the right recession 48 in the inner bottom surface 57 of the housing 13 such that the tumbler is forced to a retracted position in the housing or an extended position out of the housing. In another embodiment rounded bottom portion 58 may be replaced by any angled shaped portion known in the art, which is capable of sliding. Inner bottom surface 57 of housing 13 has an arcuate nest 47 for cradling rounded bottom portion 58 of plate spring 56, as seen in FIG. 12. A divide point 59, where the left arcuate nest 47 meets the right recession 48, confines the bottom rounded portion 58 of plate spring 56 to be forced in different directions when the vent stop is activated or deactivated. In normal operation when the user wishes to activate tumbler 80, the user will apply a downward, or inward force to button 42, this will cause rounded bottom portion 58 of plate spring 56 to move out of arcuate nest 47 and pass the divide point 59 and move into the right recession 48 of bottom surface 57 of housing 13. One must point out that arcuate nesting portion 47, divide point 59, right recession 48 of the bottom surface 57 and bottom rounded portion 58 of the plate spring 56 are of great consequence in the operation of this invention.

In addition to the tumbler cavity 55 of tumbler 80, there exists an arcuate surface 45 that interacts with an arcuate surface 50 of cylindrical peg 51. Arcuate surface 45 is preferably located on the rear bottom portion of tumbler 80. Tumbler 80 may have a protruding portion 60 located at the bottom front end wall of tumbler 80, as seen in FIG. 2. The protruding portion 60 has a top surface 61 that extends perpendicularly from the front end face 54 of the tumbler 80. The protruding portion 60 also has a first side 62, as seen in FIG. 2, and a second side, not shown, a front face 64, and a bottom 65, as shown in FIG. 12. Bottom 65 of the protruding portion 60 extends outwardly in the same direction as top surface 61 so as to meet with the outside edge of front end face 64 and is parallel to the upper surface 39 so as to come into contact with the bottom surface 57 of the housing 13 and limit further rotation of the tumbler 80 in the housing 13 when the tumbler 80 is in the retracted position. The protruding portion 60 may be designed as to allow a meshing between the protruding portion 60 and the bottom surface of top plate 21, which would cause tumbler 80 from further rotating outwardly; thus if needed, protrusion 60 could be used as a limiting device.

The release of the tumbler 80 from housing 13 can be controlled by an interaction between button 42 and plate spring 56 in tumbler 80 and bottom surface 57 of the housing 13. Button 42, as mentioned previously, is located on the rear end portion of tumbler 80, can have a grooved top surface 41, which can be in the same plane as the upper surface 39 of the tumbler 80, where the user can engage button 42 easily with any suitable instrument known in the art, including but not limited to a finger, fingernail, pen, pencil etc., as seen in FIG. 2. When the user engages grooves 41, it will move rounded bottom portion 58 of plate spring 56 from a cradled position to a freed position within cavity 38 of housing 13. In the present embodiment the user applies a downward or inward force to groove 41 of tumbler 80.

When the user wishes to activate tumbler 80, so as to prevent movement of a sliding window member, the user will exert a downward, or upward force, greater than the force being exerted by the rounded bottom portion 58 of plate spring 56 against the top surface of the arcuate nesting area 47 of the bottom surface 57 of housing 13, on groove 41, of button 42. This force will cause plate spring 56 to move in a direction opposite that of the force applied by the user. When the force applied by the user has reached the critical point, it will cause the rounded bottom portion 58 of plate spring 56 to move out of equilibrium with nesting area 47 of bottom surface 57 of housing 13 and slide across divide point 59 of bottom surface 57 of housing 13 and comes in the next equilibrium with right recession 48 of bottom surface 57 of housing 13. The critical point is reached when the force applied by the user overcomes the static frictional force, at which time bottom round portion 58 of plate spring 56 will begin to slide and the frictional force will drop back to a nearly constant value equal to that of the kinetic frictional force. When tumbler 80 is free to pivot on rotation members 53, the upward force of spring 56 will cause tumbler 80 to rotate in an outwardly direction until the rounded bottom portion 58 of plate spring 56 comes into contact with right recession 48 of bottom surface 57 of housing 13. In the same instance arcuate surface 45 of tumbler 80 will come in contact with arcuate surface 50 of cylindrical peg 51. In addition, a protruding portion 60 can also be implemented, so as to further limit movement of tumbler 80 by coming into contact with bottom surface of top plate 21. Once rounded bottom portion 58 of plate spring 56 has stopped sliding tumbler 80 will be exposed, thus preventing sliding window member from opening any further.

Figure 25:
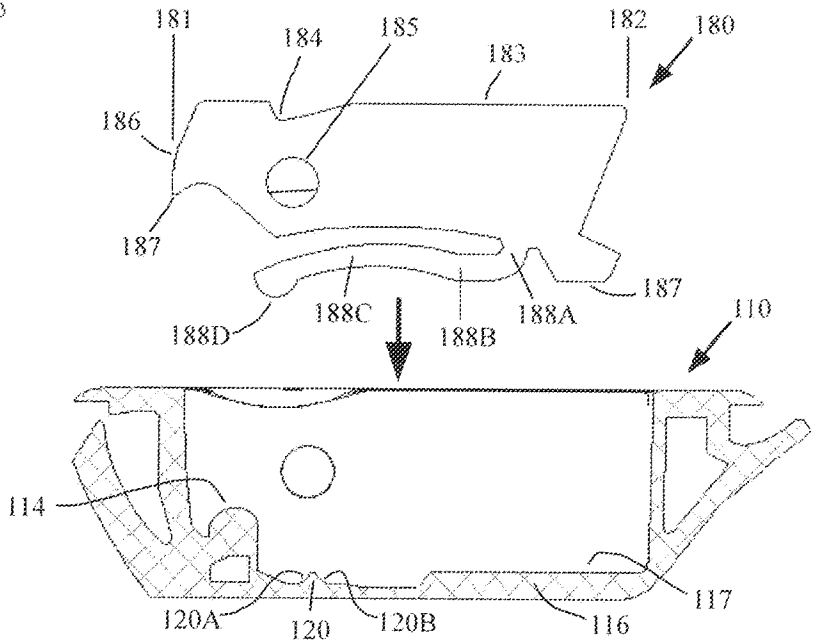
FIG. 25 is a cross-sectional view of the component parts that may be assembled to produce the vent stop of FIG. 16.
Figure 24:
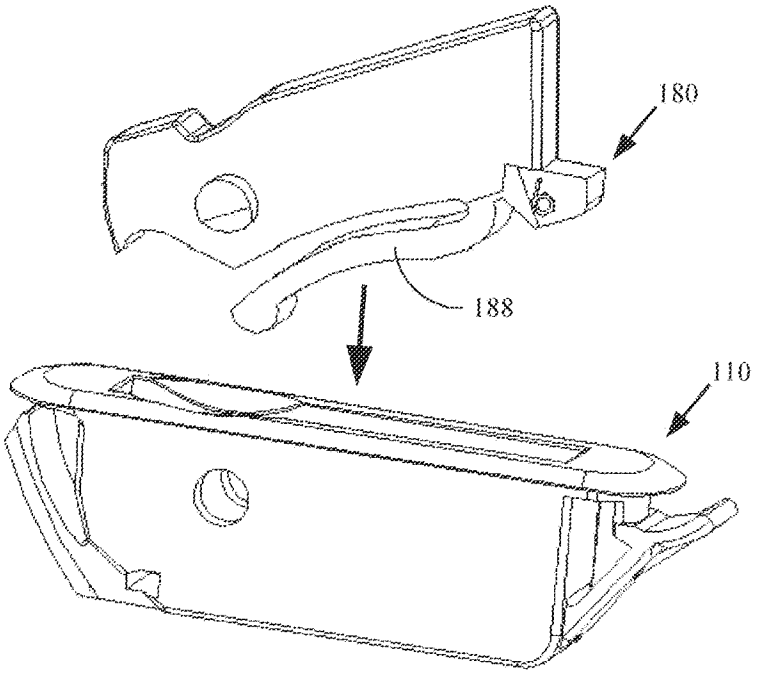
FIG. 24 is an exploded perspective view of the component parts that may be assembled to produce the vent stop of FIG. 16.

Another embodiment is shown in FIGS. 16-25, which illustrate a vent stop 100. As seen in FIGS. 24-25, vent stop 100 may be formed to include a housing 110, and a tumbler 180. Housing 110 may be formed to be substantially similar to the housing 13 that is described hereinabove. Tumbler 180 may be formed to be different than tumbler 80.

Tumbler 180 may be designed to fit within the cavity of housing 110, as shown in FIGS. 26-29, and may extend from a first end 181 to a second end 182. The tumbler may include hinge pins 185 that may be pivotally received within apertures formed in the sidewalls of housing 110. The hinge pins 185 may protrude from the side surfaces 180A and 180B of the tumbler (see FIG. 21). The tumbler 180 may thus pivot with respect to the housing 110, using hinge pins 185, between a retracted tumbler position (e.g., FIG. 29), and an extended tumbler position (e.g., FIG. 26).

Figures 26, 27, 28, 29:
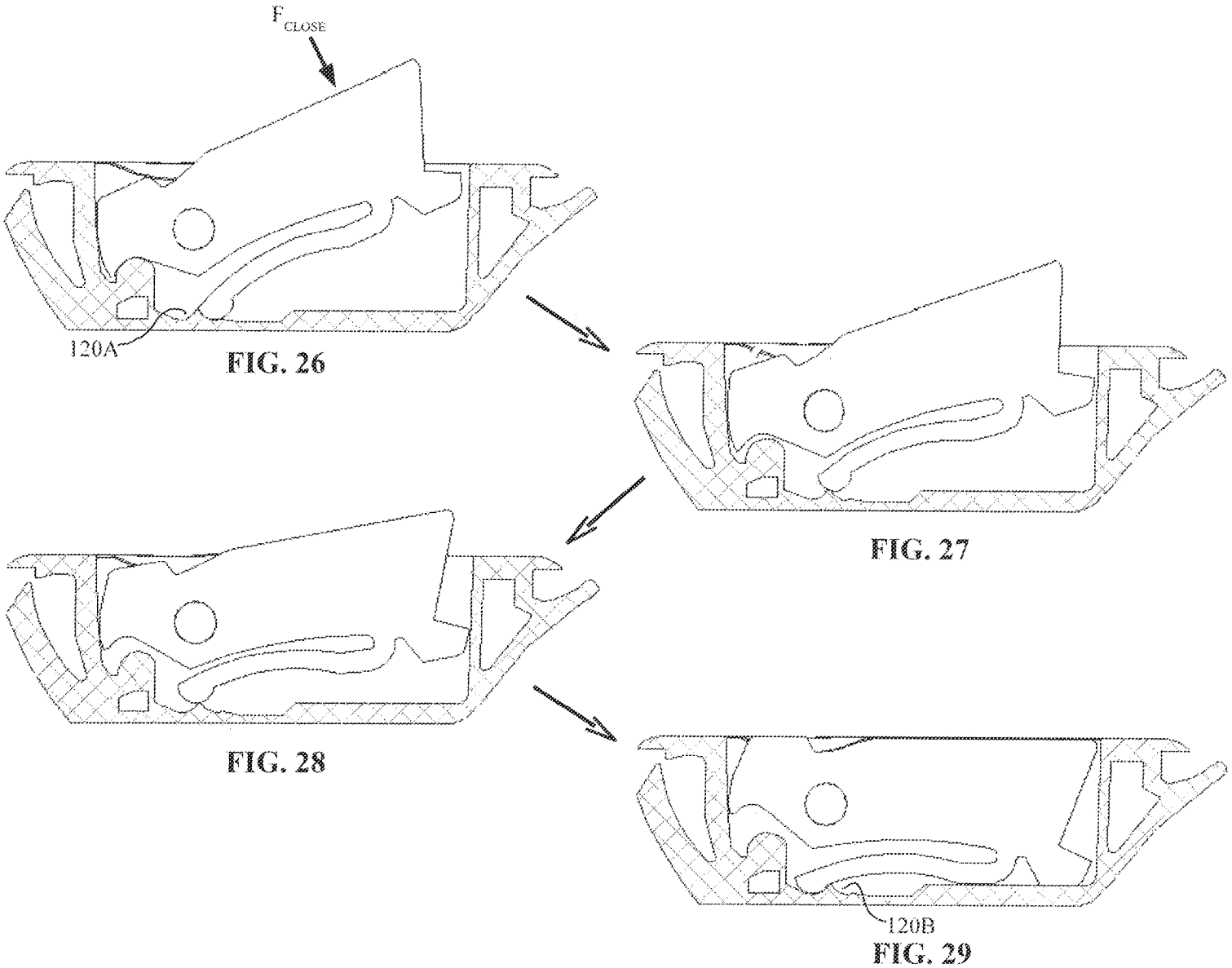
FIGS. 26-29 show a sequence of cross-sectional views in which the tumbler of the vent stop of FIG. 16 is actuated from the extended position into the retracted position.
Figures 30, 31, 32, 33:
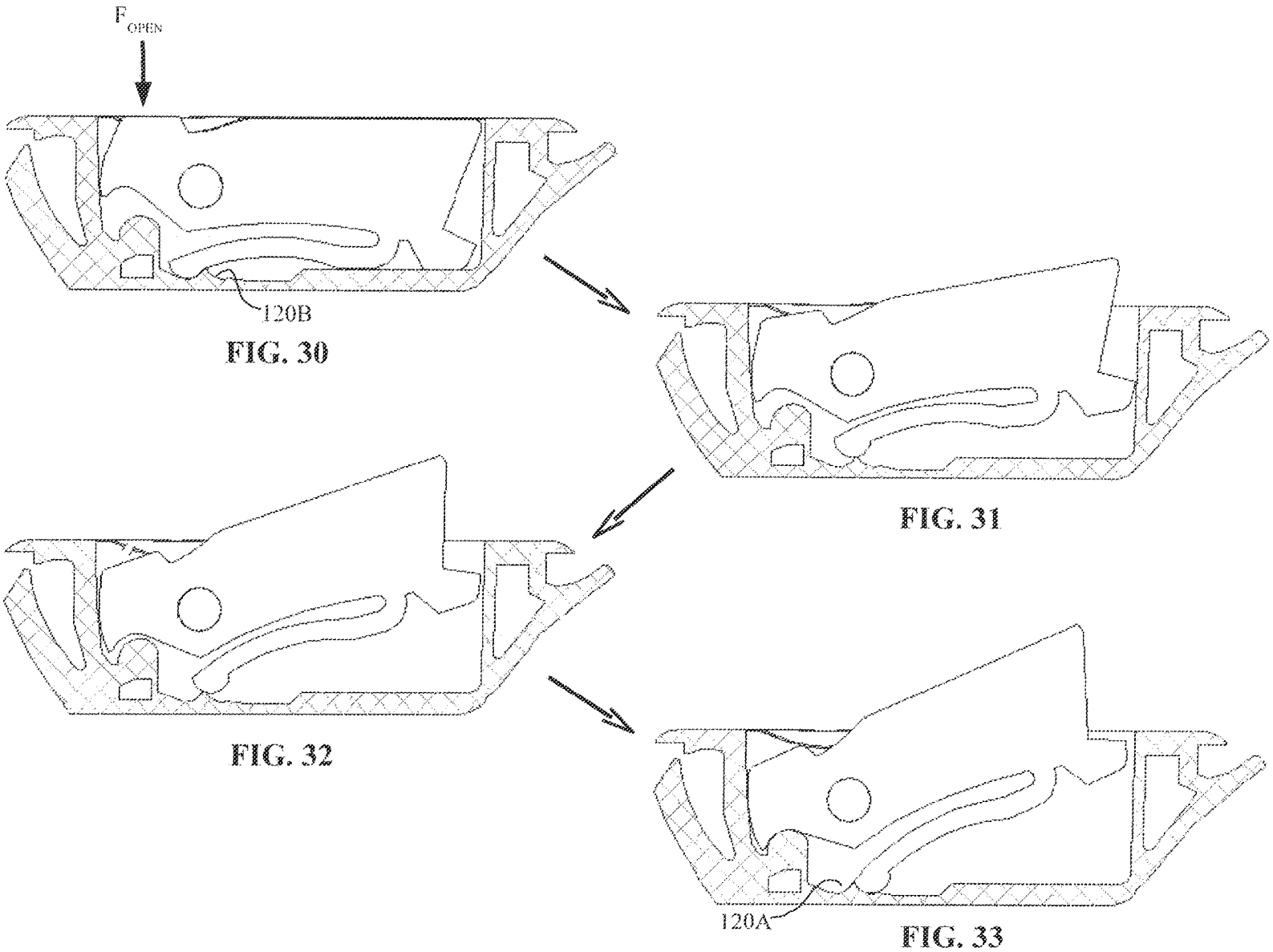
FIGS. 30-33 show a sequence of cross-sectional views in which the tumbler of the vent stop of FIG. 16 is actuated from the retracted position into the extended position.
Figure 34:
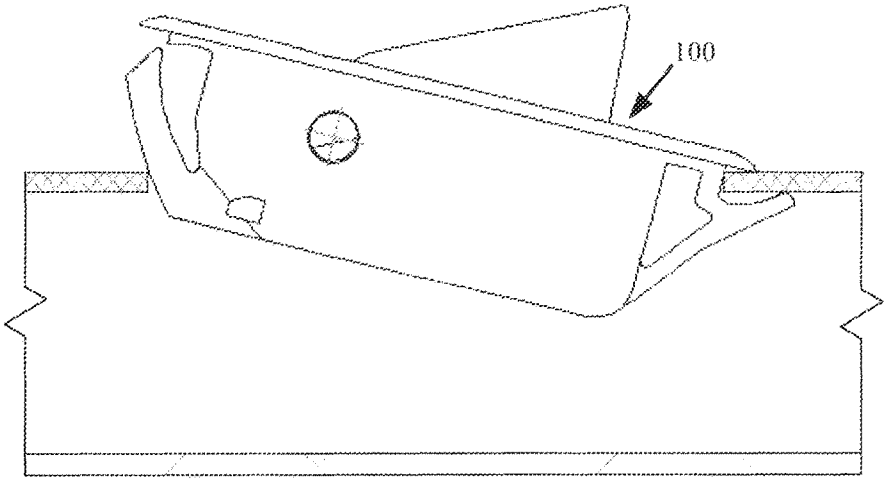
FIG. 34 is a side cross-sectional view showing the vent stop of FIG. 16 being initially positioned within a slotted opening in a window or door sash.
Figure 35:
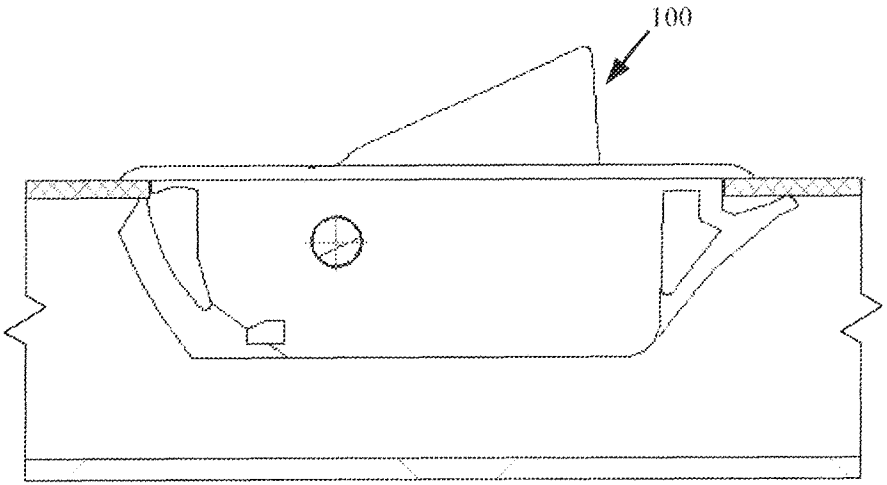
FIG. 35 is the side cross-sectional view of FIG. 34, but is shown after the vent stop is fully inserted and retained within the slotted opening.
Figure 36:
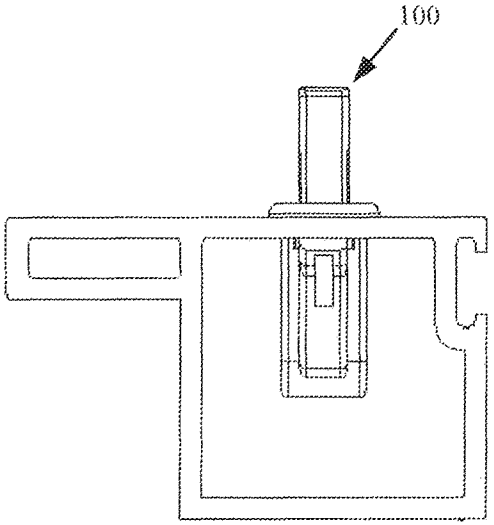
FIG. 36 is an end view of the vent stop after being fully inserted and retained within the slotted opening, as shown in FIG. 35.

The tumbler 180 may have an upper surface 183, which may be smooth and/or substantially flat for at least a portion thereof, as seen in FIG. 25. Tumbler 180 may have an indentation 184 that may be formed to divide the upper surface 183 of the tumbler into two portions, with the indent being positioned in proximity to a minimum distance point with respect to the hinge pins 185. The indent 184 may thus provide an indication of the hinge pin location, and also therefore which side of the upper surface 183 should be pushed for it to pivot in a particular direction. The rear side 186 of tumbler 180 may slope downward, as shown in FIG. 25, and may form a point 187 where the rear side 186 meets the arcuate bottom surface portion 189. Outward pivoting of the tumbler 180 may occur until the bottom surface portion 145 contacts, and has its movement stopped by, a surface 114 of the housing 110, as seen in FIG. 26. Inward pivoting of the tumbler 180 may be limited to the retracted position shown in FIGS. 29 and 30 by the lowermost surface of a protruding stop feature 187 contacting a bottom interior surface 117 of a bottom wall 116 of the housing 110. As discussed hereinafter, the protruding stop feature 187 may protrude away from a bottom portion of the tumbler 180 in proximity to the second end 182.

Tumbler 180 may be formed with a front end surface 146. When the tumbler 180 is in the extended tumbler position, a substantial portion of the front end surface 54 is exposed outside of the housing 110, which exposed portion may prevent movement of a sliding window/door sash member. In one embodiment, the positioning/angle of the front end surface 54 with respect to the positioning of the arcuate bottom surface portion 145 and the hinge pins 185 may be such that when it is exposed in the extended tumbler position, it may be substantially perpendicular to the outermost surface of the top plate of the housing 110.

Tumbler 180 may also be formed with a selectively shaped elongated protrusion 188 (FIG. 24). The elongated protrusion 188 may extend from a bottom surface, in proximity to the protruding stop feature 187, which may preferably be positioned in proximity to the second end 182, so that the selectively shaped elongated protrusion 188 may similarly protrude down from the bottom surface of the tumbler to also be in relatively close proximity to the second end 182. The elongated protrusion 188 may have a first portion 188A (FIG. 25) that may extend away from the bottom surface, and which may transition into a second portion 188B that may extend generally towards the first end 181 and also generally back towards the bottom surface of the tumbler. The second portion 188B may transition into a third portion 188C that may be curved, and which may generally curve away from the bottom surface, as seen in FIG. 25. A bulbous feature 188D may be formed at the end of the third portion 188C. The bulbous feature 188D may be formed to have a radiused surface that may protrude radially away from the bottom surface, as seen in FIG. 25. The positioning and the sizing of the radius of the bulbous feature 188D is configured to correspond to the positioning and size of an apex 120 that may be formed in the cavity of the housing 110 on the interior surface of the bottom wall 116, adjacent to correspondingly curved surfaces 120A and 120B also formed in the bottom wall 116. The bulbous feature 188D may thus operate similar to the rounded bottom portion of the plate spring 56 that is used in conjunction with tumbler 80, as discussed hereinabove.

Figure 16:
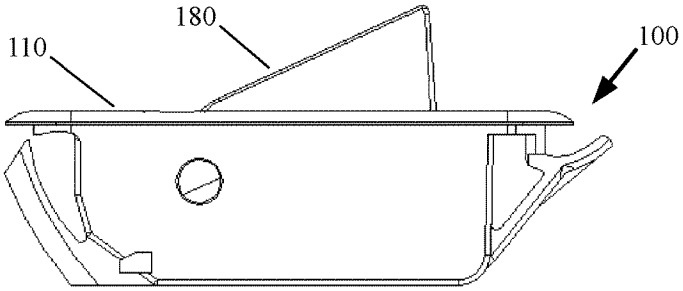
FIG. 16 is a side view of another vent top embodiment in accordance with the present invention, with the tumbler shown in the extended position.
Figure 17:
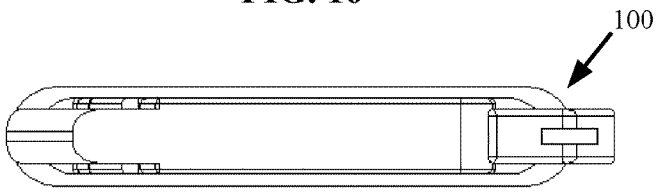
FIG. 17 is a bottom view of the vent stop of FIG. 16.
Figure 20:
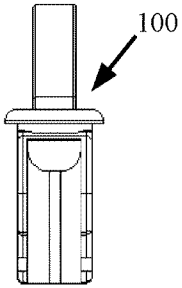
FIG. 20 is a first end view of the vent stop of FIG. 16.
Figure 22:
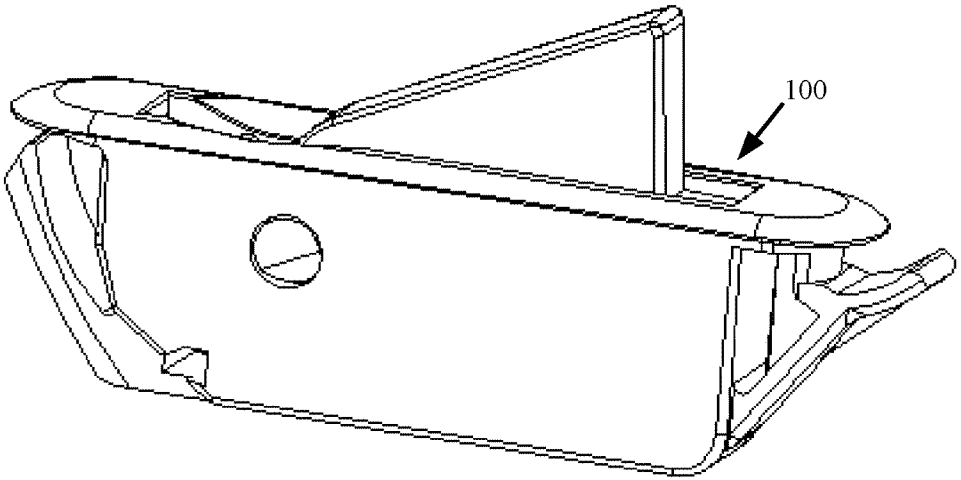
FIG. 22 is a first perspective view of the vent stop of FIG. 16.
Figure 23:
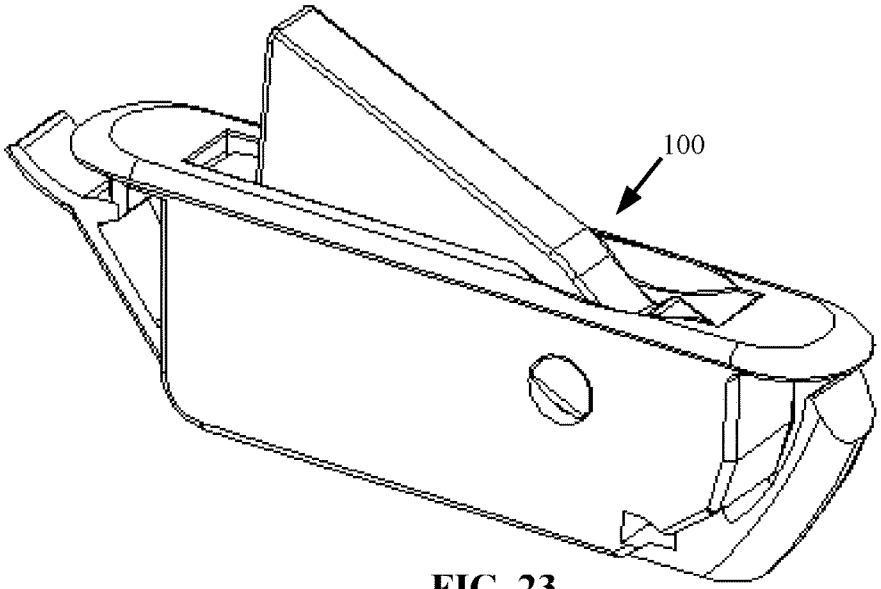
FIG. 23 is a second perspective view of the vent stop of FIG. 16.

FIGS. 26-29 show a sequence of cross-sectional views in which the tumbler of the vent stop of FIG. 16 is actuated from the extended position into the retracted position. FIGS. 30-33 show a sequence of cross-sectional views in which the tumbler of the vent stop of FIG. 16 is actuated from the retracted position into the extended position.

As may be seen in those figures, the flexible elongated protrusion 188 is configured to bi-directionally bias the tumbler 180, according to movement of the bulbous feature 188D of the flexible elongated protrusion 188, and its contact with respect to the apex 120.

When the tumbler 180 is in the retracted tumbler position (FIG. 30), actuation of its upper surface 183 by application of a force $F_{OPEN}$ proximate to the first end 181 (i.e., to the "left" side of the indent 184 as shown therein) is configured to cause the bulbous feature 188D of the flexible elongated protrusion 188 to cross the apex 120. Subsequent contact between the bulbous feature 188D and the apex 120 is configured to bias the tumbler to pivot out of the cavity toward the extended position shown in FIG. 33, until the bulbous feature is nested within the surface 120B of the bottom wall 116 of the housing 110.

When the tumbler 180 is in the extended position (FIG. 26), actuation of its upper surface 183 by application of a force $F_{CLOSE}$ proximate to the second end 182 (i.e., to the "right" side of the indent 184 as shown therein) is configured to cause the bulbous feature 188D to cross the apex 120. Subsequent contact between the bulbous feature 188D and the apex 120 is configured to bias the tumbler toward the retracted position shown in FIG. 29, until the bulbous feature is nested within the surface 120A on the bottom wall 116 of the housing 110.

Figure 37:
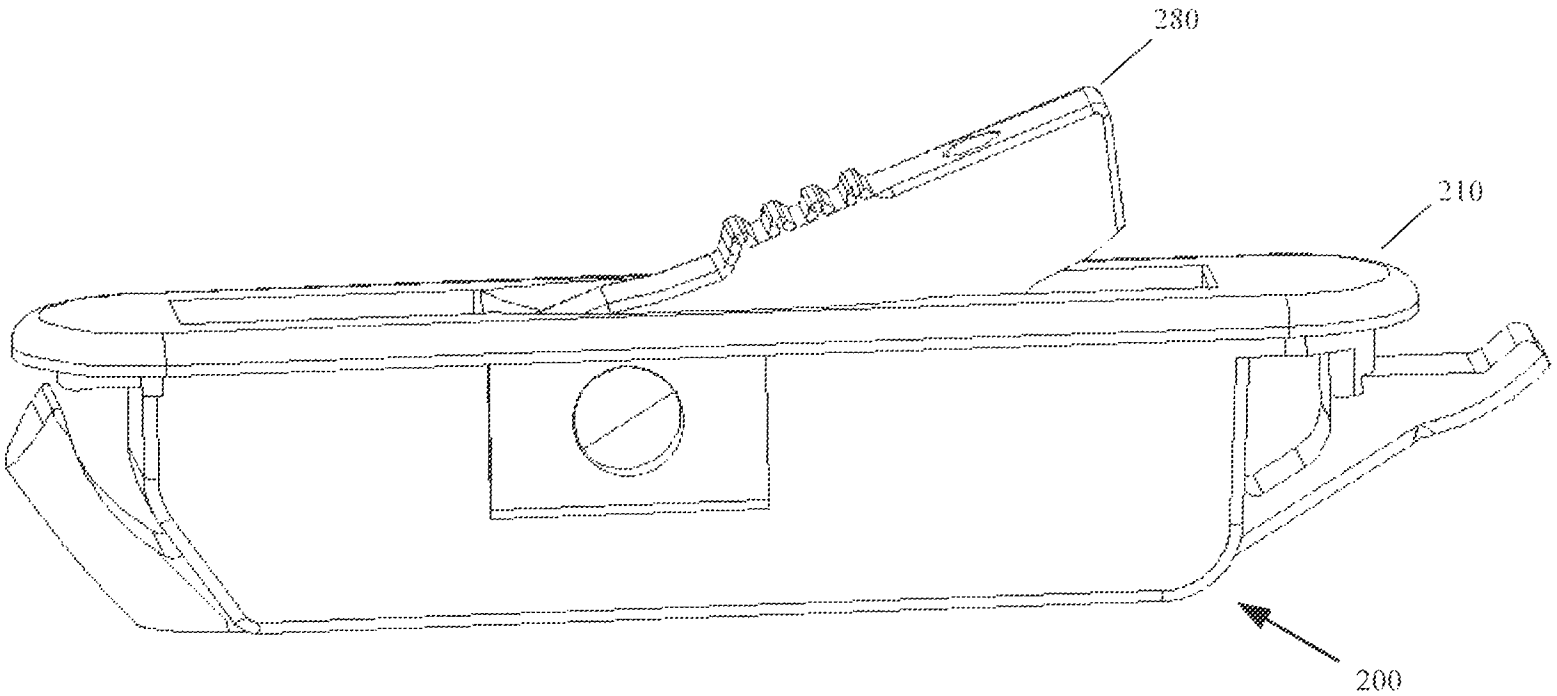
FIG. 37 is a perspective view of yet another vent stop embodiment.
Figure 39:
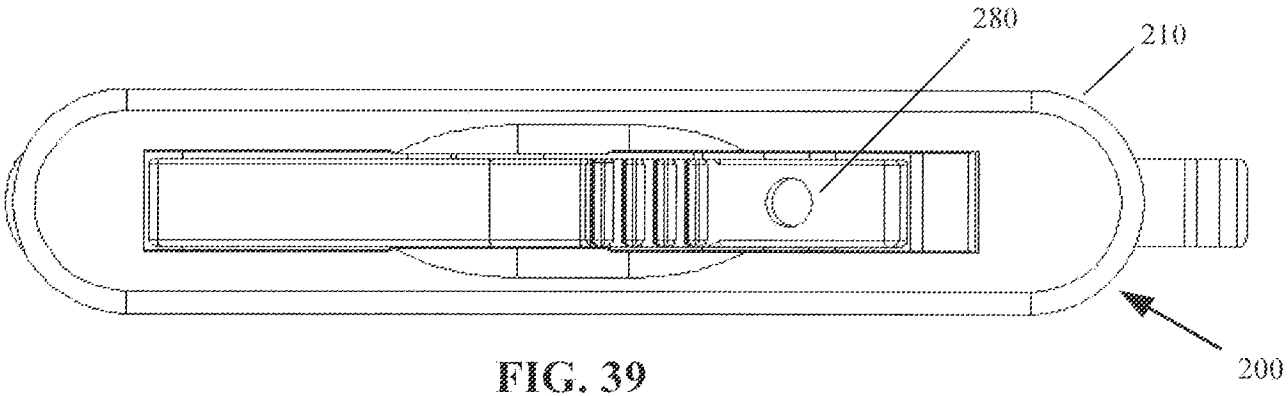
FIG. 39 is a top view of the vent stop of FIG. 37.
Figure 38:
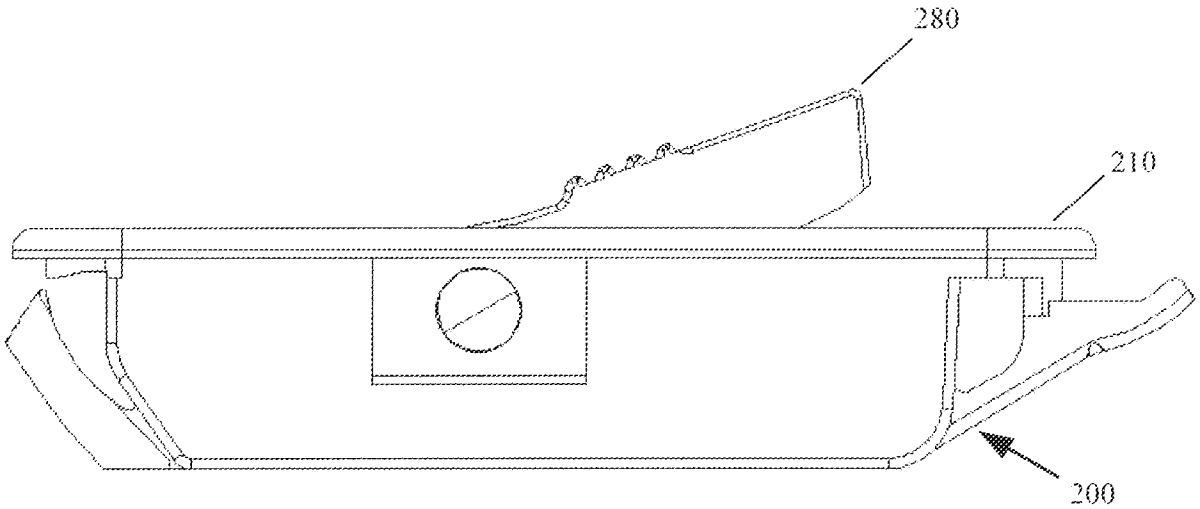
FIG. 38 is a side view of the vent stop of FIG. 37.
Figure 40:
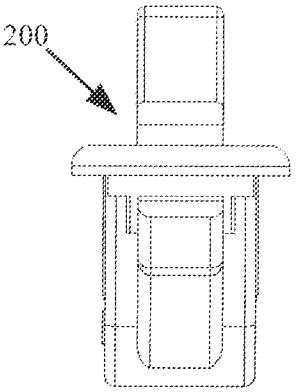
FIG. 40 is an end view of the vent stop of FIG. 37.

Another embodiment is shown in FIGS. 37-58, which illustrates a vent stop 200. As seen in the perspective views of FIGS. 37 and 41, vent stop 200 may be formed to include a housing 210, and a tumbler 280. Housing 210 may be formed similar to the housing 110 described hereinabove, and tumbler 280 may be formed similar to tumbler 180.

Figure 48:
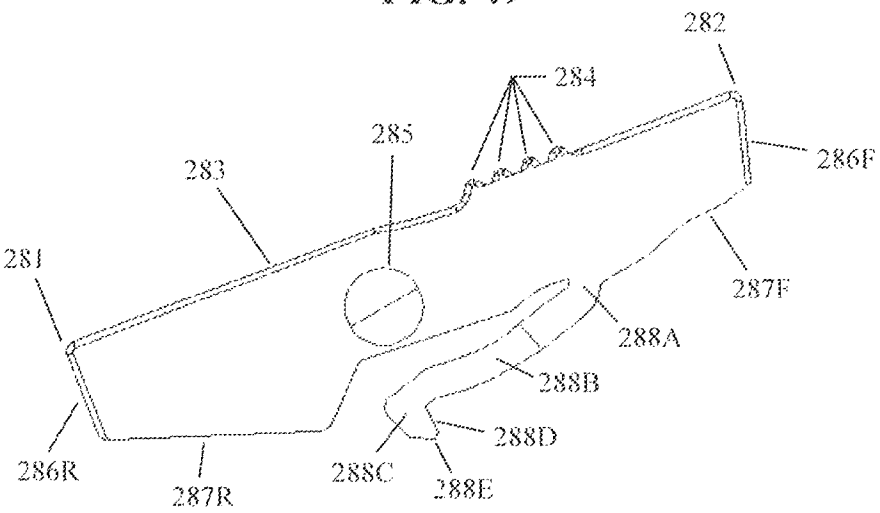
FIG. 48 is a side view of the tumbler of the vent stop of FIG. 37.
Figure 50:
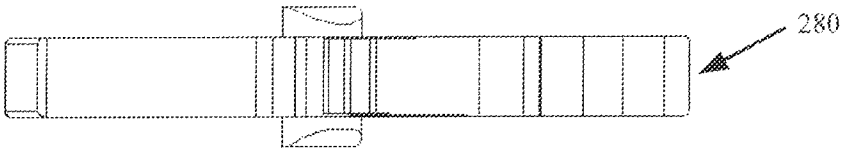
FIG. 50 is a bottom view of the tumbler of FIG. 48.
Figure 51:
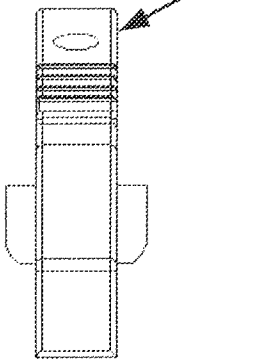
FIG. 51 is a first end view of the tumbler of FIG. 48.
Figure 53:
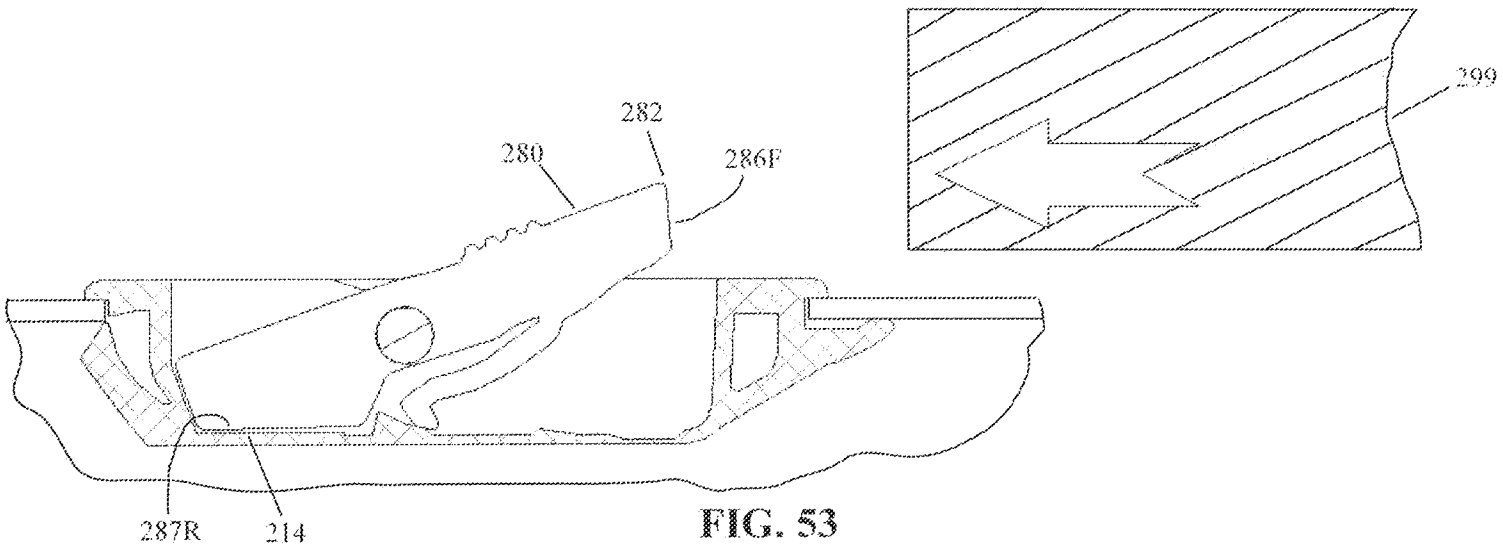
FIG. 53 is a side cross-sectional view through the vent stop of FIG. 37 when installed in a sliding sash window or door, shown with the tumbler in the second tumbler position, and with a sliding sash member positioned distally, but being moved towards the tumbler of the vent stop.
Figure 54:
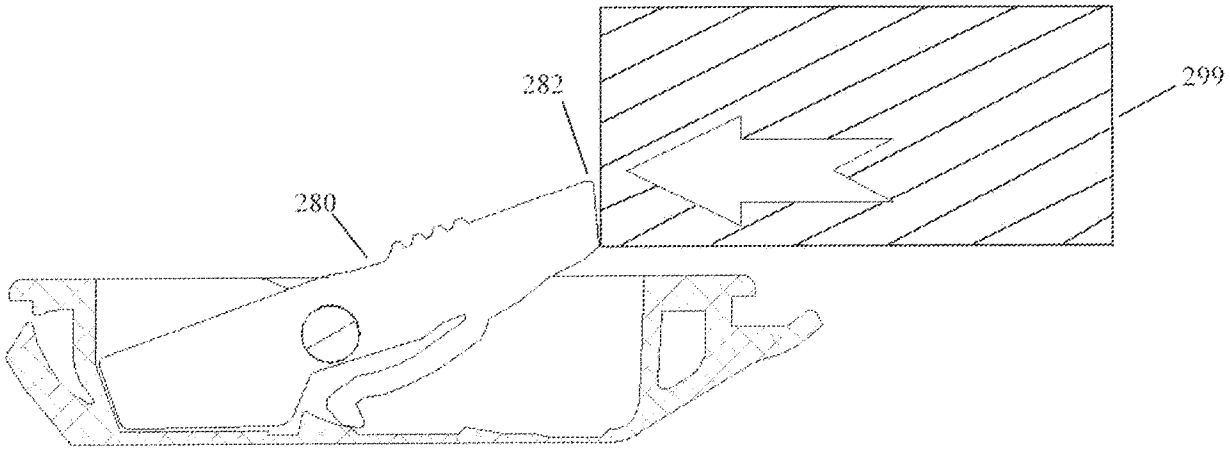
FIG. 54 is the side cross-sectional view of FIG. 53, but is shown after the sliding sash member has contacted, and had its sliding travel restricted/limited by, the tumbler positioned in the second tumbler position.

Tumbler 280 may be formed to fit within the cavity of housing 210, as shown in FIGS. 53-58, and as seen in FIG. 48 the tumbler may extend from a first end 281 to a second end 282. The tumbler may include hinge pins 285 that may be pivotally received within apertures formed in the sidewalls of housing 210. The hinge pins 285 may protrude from the side surfaces 289A and 289B of the tumbler (see FIG. 52). The tumbler 280 may thus pivot with respect to the housing 210, using hinge pins 285, between a first tumbler position (FIG. 55), and a second tumbler position (FIG. 53 and FIG. 54).

The tumbler 280 may have an upper surface 283, which may be smooth and/or substantially flat for at least a portion or portions thereof, as seen in FIG. 48. The upper surface 283 of the tumbler 280 may have a plurality of ridges 284 formed thereon. The rear side 286R of tumbler 280 may extend laterally away from the upper surface 283 at the first end 281, and a rear stop side surface 287R may extend away from the end of the rear side surface 286R. The front side 286F of tumbler 280 may extend laterally away from the upper surface 283 at the second end 282, and a front stop surface 287F may extend away from the end of the front side surface 286F.

Figure 55:
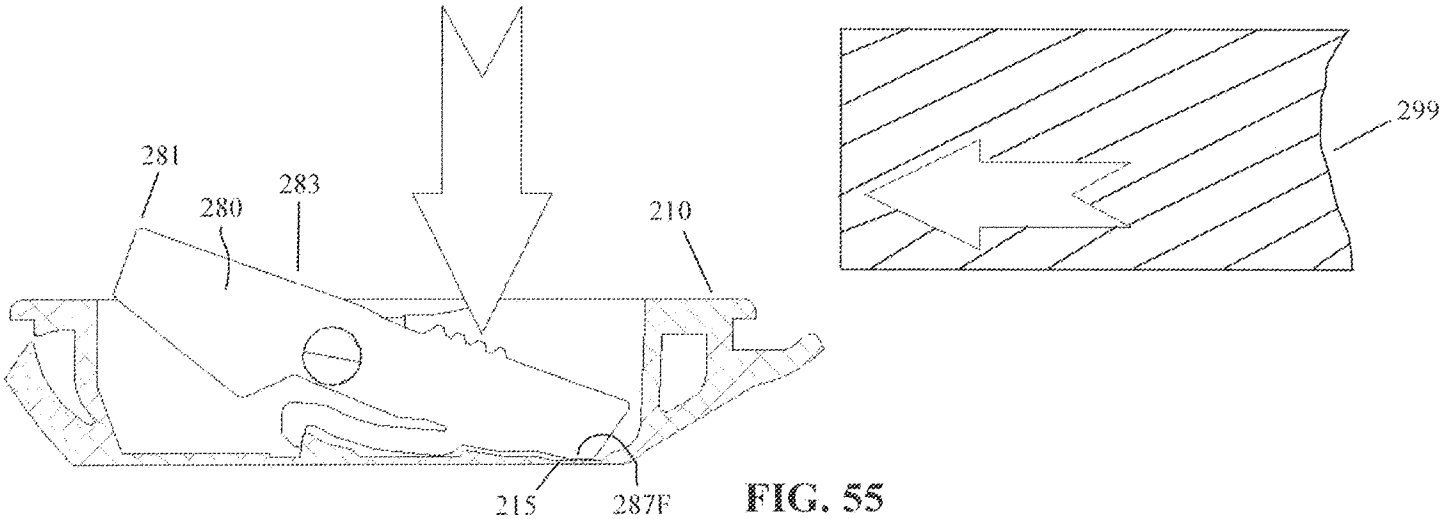
FIG. 55 is the side cross-sectional view of FIG. 53, but is shown after a user has applied a force to the tumbler to pivot it into a first tumbler position, where it no longer restricts movement of the sash member, and where it is releasably maintained by a surface of the integral spring member of the tumbler being engaged with a surface of a contoured feature on the bottom wall of the housing.

Pivoting of the tumbler 280 away from the first tumbler position shown in FIG. 55 may occur until the rear stop side surface 287R contacts, and has its movement stopped by, a surface 214 in the cavity of the housing 210, as seen in FIG. 53, for the tumbler to occupy the second tumbler position. Pivoting of the tumbler 280 away from the second tumbler position shown in FIG. 53 may occur until the front stop side surface 287F contacts, and has its movement stopped by, a surface 215 in the cavity of the housing 210, as seen in FIG. 55, for the tumbler to occupy the first tumbler position.

The front side 286F of tumbler 280 may be formed at such an angle with respect to the rear stop side surface 287R that when the tumbler 280 is in the second tumbler position, at least a substantial portion of the front side surface 286F is exposed outside of the housing 210, which exposed portion may prevent movement of a sliding window/door sash member (FIG. 54). In one embodiment, the positioning/angle of the front side 286F when the tumbler 280 is in the second tumbler position may be such that it may be substantially perpendicular to the bottom surface of the top plate of the housing 210, and may thus have a substantial portion thereof be oriented to bear up against and stop the sliding movement of a sash member.

Figure 41:
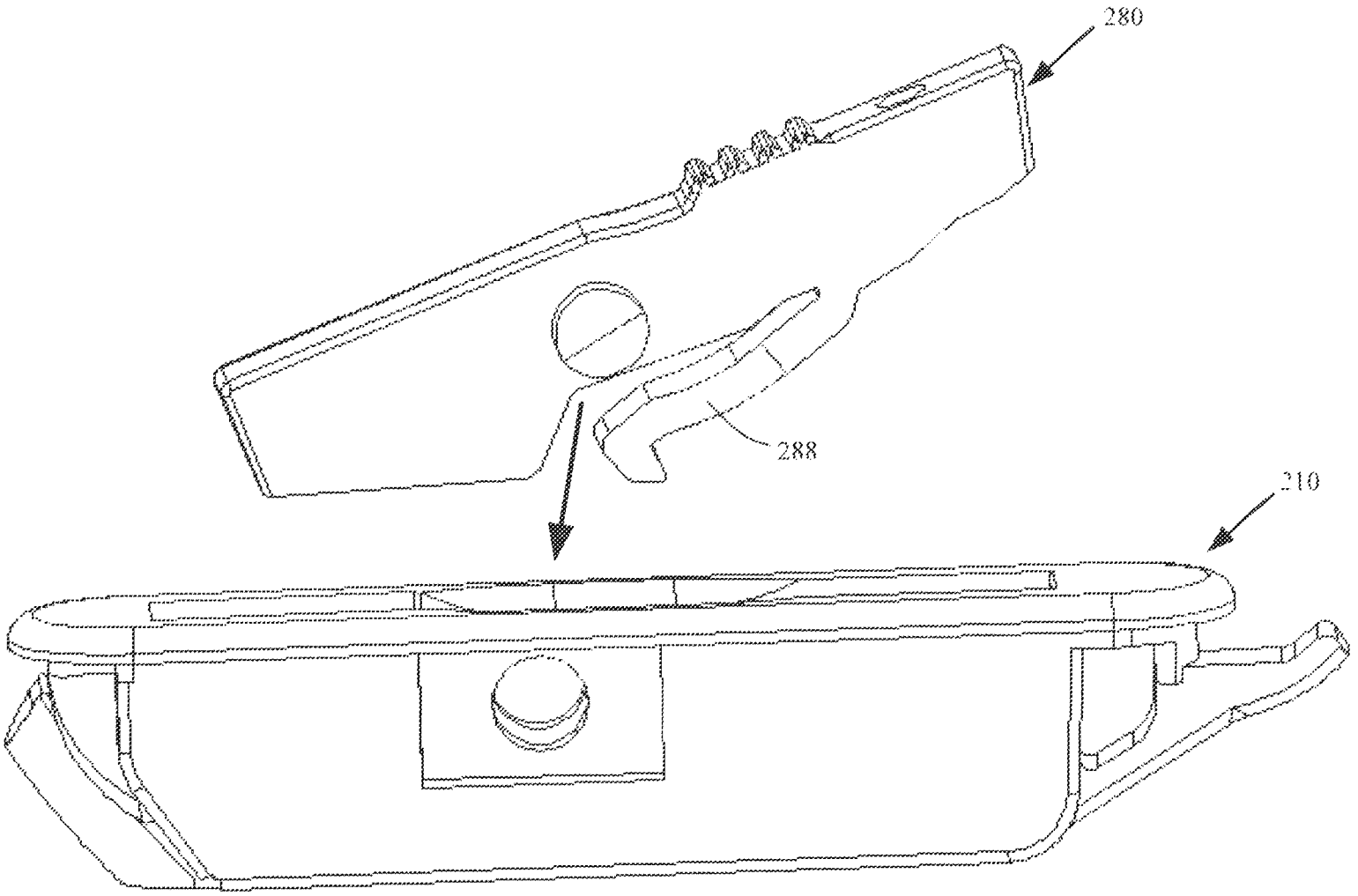
FIG. 41 is an exploded perspective view of the housing and tumbler of the vent stop of FIG. 37.
Figure 43:
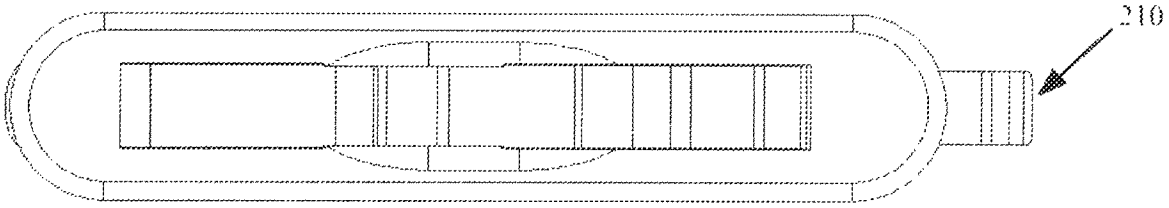
FIG. 43 is a top view of the housing of FIG. 42.
Figure 42:
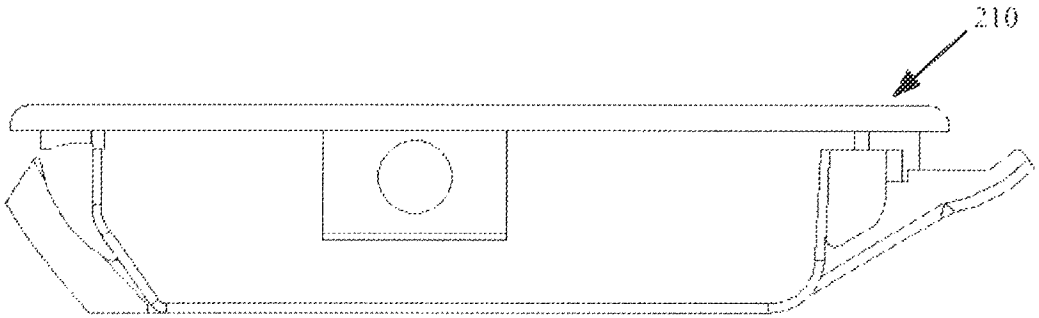
FIG. 42 is a side view of the housing of the vent stop of FIG. 37.
Figure 45:
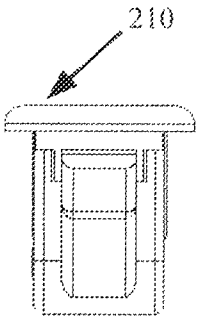
FIG. 45 is a first end view of the housing of FIG. 42.
Figure 44:
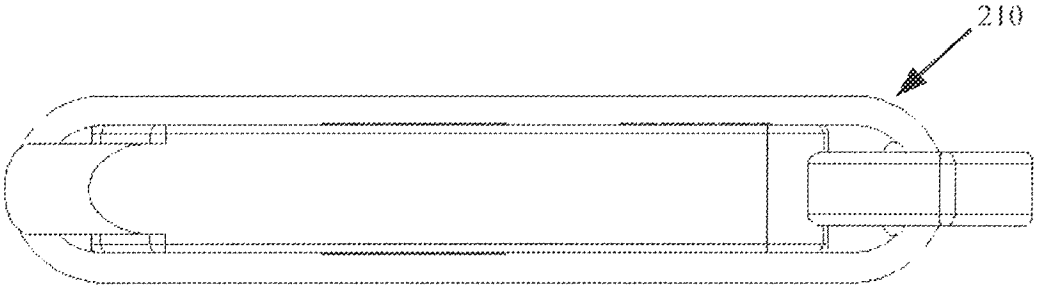
FIG. 44 is a bottom view of the housing of FIG. 42.
Figure 46:
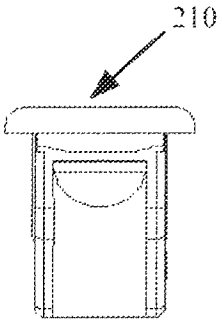
FIG. 46 is a second end view of the housing of FIG. 42.
Figure 47:
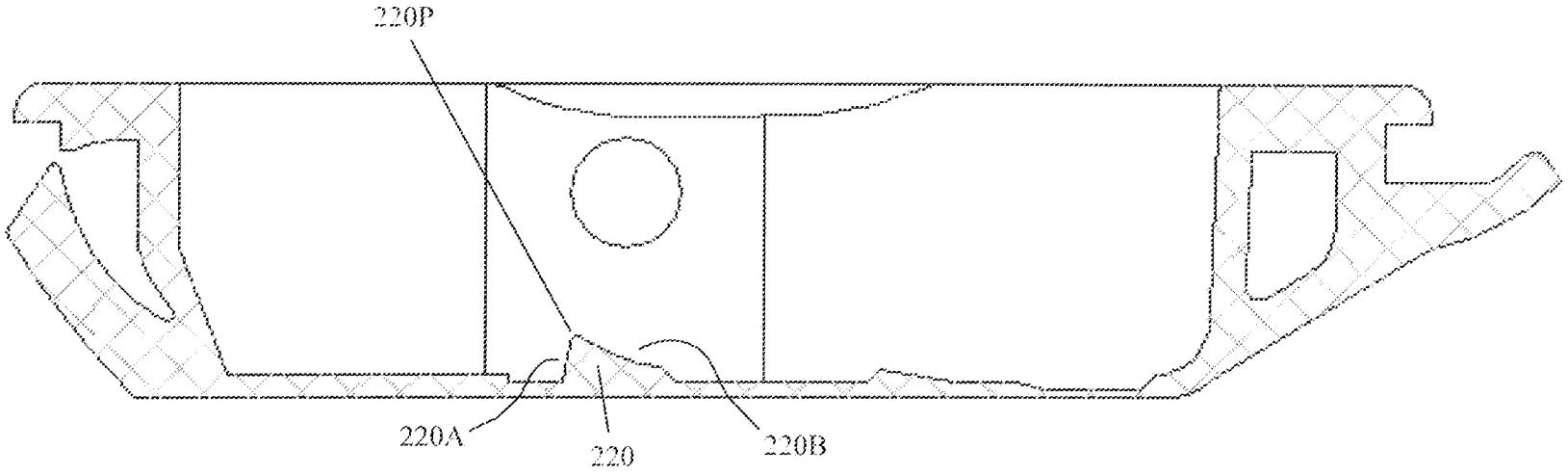
FIG. 47 is a cross-sectional view through the housing of FIG. 42.
Figure 52:
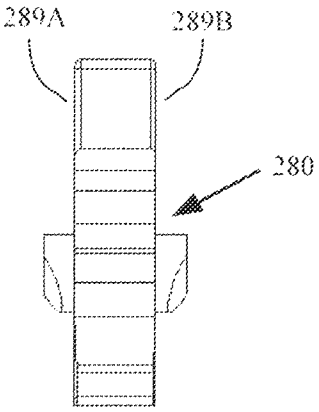
FIG. 52 is a second end view of the tumbler of FIG. 48.
Figure 49:
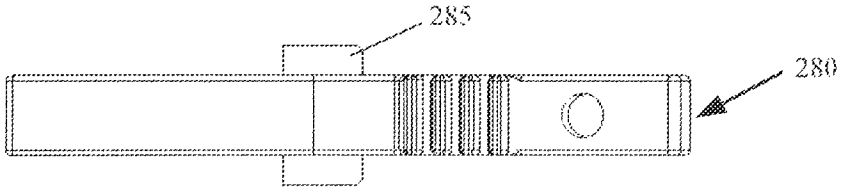
FIG. 49 is a top view of the tumbler of FIG. 48.

Tumbler 280 may also be formed with a selectively shaped and elongated protrusion 288 (FIG. 41). As shown in FIG. 48, the elongated protrusion 288 may have a first portion 288A that may extend laterally away from a bottom surface of the tumbler, in closer proximity to the front stop surface 287F than the rear stop surface 287R. The first portion 288A of the elongated protrusion 288 may transition into a second portion 288B that may extend generally towards the first end 281. The second portion 288B may extend far enough toward the first end 281 to have a suitable length and cross-section to provide a spring constant sufficient to appropriately bias the mass of the tumbler. The second portion 288B may transition into a third portion 288C that has a portion that may generally extend in a direction that is substantially perpendicular to the upper surface 283. A particularly angled surface 288D may be formed on the third portion 288C. The positioning and the angle of the surface 288D is configured to correspond to the positioning of a surface 220A of a protrusion 220 formed on the bottom wall 216 in the cavity of the housing 210 (see FIG. 47 and FIG. 55A). The surface 220A of the housing protrusion 220 may transition into another surface 220B to form an apex 220P. The third portion 288C is similar to the rounded bottom portion of the plate spring 56 that is used in conjunction with tumbler 80, as discussed hereinabove, but is configured to operate somewhat differently.

Figure 58:
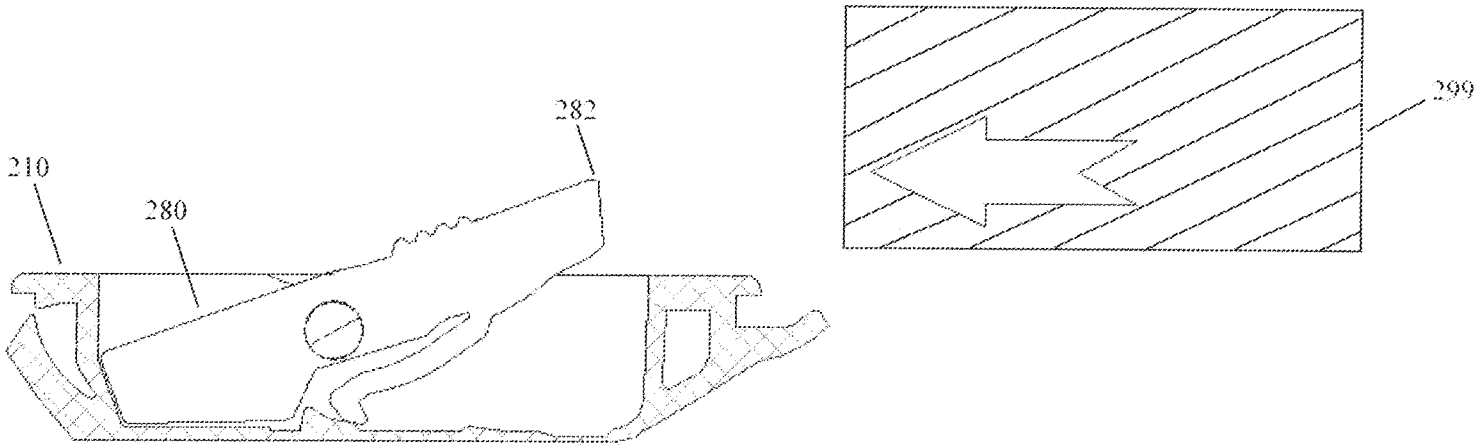
FIG. 58 is the side cross-sectional view of FIG. 57, but is shown after the sliding sash member has moved back into the open position, with the tumbler being biased back into the second tumbler position.

FIG. 55 shows the tumbler 280 in the first tumbler position, in which at least a portion of the first end 281 of the tumbler protrudes out from the opening in the top plate of the housing 210. FIG. 54 and FIG. 58 show tumbler 280 in the second tumbler position, in which at least a portion of the second end 282 of the tumbler protrudes out from the opening in the top plate of the housing 210 sufficiently to restrict/inhibit movement of a sliding sash member 299 from being opened past the location of the vent stop 200.

In one embodiment, the second end 282 of the tumbler 280 that protrudes out from the opening in the housing top plate when in the second tumbler position may be finger actuated by a user to move it into the first tumbler position, and the first end 281 of the tumbler 280 that protrudes out from the opening in the housing top plate when in the first tumbler position may be finger actuated to move it into the second tumbler position. The elongated protrusion 288 may act as a leaf spring and may serve to bi-directionally bias the body of the tumbler 280, as it moves with respect to the apex 220P of the housing protrusion 220.

Figure 55A:
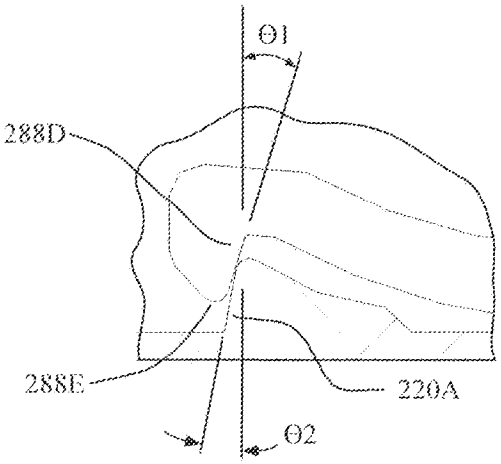
FIG. 55A is an enlarged detail view of a portion of the cross-sectional view of the housing and tumbler, as shown in FIG. 55.

When the tumbler 280 is in the first tumbler position (FIG. 55), actuation proximate to the first end 281 of the tumbler causes the curved distal end 288E of the flexible elongated member 288 to elevate from its positon in FIG. 55A and cross the apex 220P, and subsequent contact between the distal end of the flexible elongated member and the surface 220B on the bottom wall of the housing (FIG. 56) generally biases the tumbler to pivot further toward, and into the second tumbler position. When the tumbler 280 is in the second tumbler position (FIG. 58), actuation of the second end 282 of the tumbler causes the distal end 288E of the flexible elongated member 288 to cross the apex 220P, and subsequent contact between the distal end of the flexible elongated member and the surface 220A on the bottom wall of the housing biases the tumbler to pivot further toward, and into the first tumbler position.

In another embodiment, the extent that the first end 281 of tumbler 280 protrudes out from the opening in the housing top plate when in the first tumbler position (FIG. 55) may be coordinated with the positioning and travel of the sash member 299, and with the angled surface 288D of the elongated protrusion 288 and the surface 220A of the housing protrusion 220. They may be coordinated such that sliding of the sash member 299 contacts the tumbler 280 (FIG. 55 and FIG. 56), and the biasing by the elongated protrusion 288 may cause the tumbler to independently move into the second tumbler position without being directly actuated by a user, to place the vent stop into a safe position, preventing full opening of the window, when the window is moved back into a closed position (FIG. 57 and FIG. 58).

The full cycle of movement of tumbler 280 with respect to its interaction with a sliding sash member may be seen in FIGS. 53-58.

In FIG. 53, the tumbler 280 is shown in the second tumbler position, and with a sliding sash 299 member positioned distally, but being moved towards the tumbler, as indicated by the arrow in the sash member. In FIG. 54 the sliding sash member 299 has contacted, and has had its sliding travel restricted/limited by the second end 282 of the tumbler 280 blocking the sliding movement of the sash member.

FIG. 55 is the side cross-sectional view of FIG. 54, but is shown after a user has applied a force to the second end 282 of the tumbler 280, as indicated by the arrow directed towards the plurality of ridges 284, which pivots the tumbler into the first tumbler position where it no longer restricts movement of the sash member 299. As noted above, the tumbler 280 is releasably maintained in the first tumbler position by the angled surface 288D of the elongated protrusion 288 being engaged with the surface 220A of the housing protrusion 220 (FIG. 47), which is shown enlarged within FIG. 55A. The arrow pictured in the sash member 299 of FIG. 55 indicates that the sash is being slid towards the vent stop 200.

Figure 56:
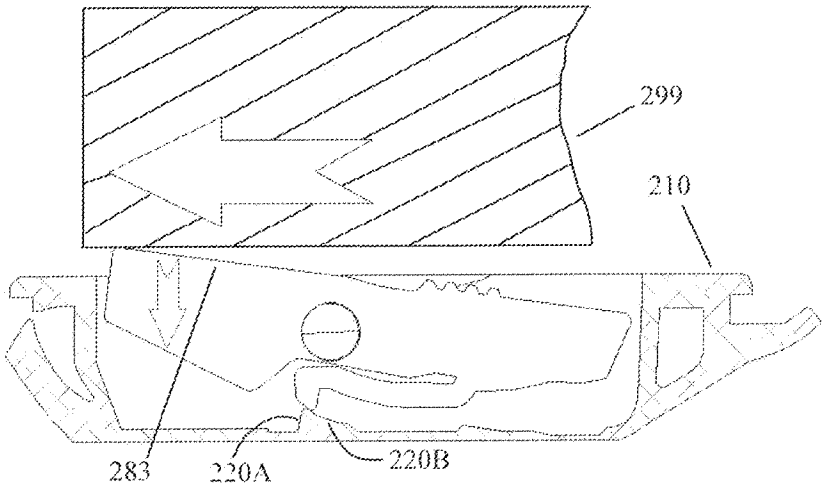
FIG. 56 is the side cross-sectional view of FIG. 55, but is shown after the sliding sash member has been moved further towards a fully opened position to contact the angled protruding surface of the tumbler, and trigger the release of the tumbler from its first position.
Figure 57:
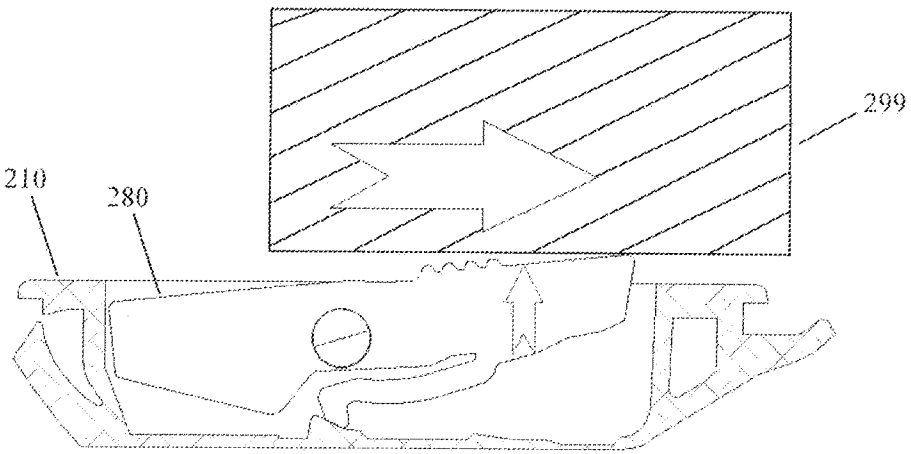
FIG. 57 is the side cross-sectional view of FIG. 56, but is shown with the sliding sash member being moved back towards a closed position, and with the second end of the tumbler biased into contact with the sash member.

FIG. 56 is the side cross-sectional view of FIG. 55, but is shown after the sliding sash member 299 has been slid further towards a fully opened sash position and has not only contacted the protruding "upper" surface 283 of the tumbler 280, but has pivoted the tumbler. This amount of pivotal movement of the tumbler is coordinated to trigger the release of the tumbler from its first tumbler position through pivotal movement of the tumbler causing the angled surface 288D of the elongated protrusion 288 to disengage from the surface 220A of the housing protrusion 220, and move onto surface 220B, which contact immediately biases the tumbler to pivot toward the second tumbler position, and it will occupy the position shown in FIG. 57 (i.e., the second end 282 of the tumbler 280 is biased into contact with the side of the sash member 299).

In order that a relatively slight lateral displacement of the tumbler 280 resulting from contact by the sliding sash member 299 serves to trigger the disengagement of the elongated protrusion 288 from the housing protrusion 220, the angled surface 288D of the elongated protrusion 288 and the surface 220A of the housing protrusion 220, may be at a relatively steep angle, which may require a higher force to disengage, such as that provide by the relatively large mass of a sliding sash window or door. Also the engagement therebetween may be very small, as seen in FIG. 5A. Moreover, as seen in FIG. 55A, the angled surface 288D of the elongated protrusion 288 may be oriented at the angle Θ1 that may be slightly larger than the angle Θ2 at which the surface 220A of the housing protrusion 220 may oriented, so that the surface 288D may engage the surface 220A at a point very near the apex 220P. In FIG. 55A, the angle Θ1 is show at about 16 degrees, and the angle Θ2 is shown to be about 11 degrees, having about a five degree difference therebetween. The difference between the angles Θ1 and Θ2 may be in the range of zero degrees to three degrees in one embodiment, and may be in the range of three degrees to six degrees in another embodiment, and may be in the range of six degrees to ten degrees or more in another embodiment, and may also be a combination of such ranges in yet another embodiment. Also, as to the steepness of the surface 220A, the angle Θ1 may range in the range of zero degrees and seven degrees in one embodiment, between seven degrees and fourteen degrees in another embodiment, and between fourteen degrees and twenty degrees or more in another embodiment, and may also be a combination of such ranges in yet another embodiment.

After the sliding sash member 299 has triggered the release of the tumbler 280 from its second tumbler position, as shown in FIG. 56, to occupy the position shown in FIG. 57, subsequent movement of the sash member toward the closed sash position would move the sash member clear of the vent stop 200, as shown by the arrow in the sash in FIG. 57. Once the sash member 299 is moved beyond the vent stop 200, the tumbler 280 is no longer prevented from reaching the second tumbler position, and is biased thereto, as shown in FIG. 58.

After the sliding sash member 299 has triggered the release of the tumbler 280 from its first tumbler position, and has been biased from the position shown in FIG. 56 into the position shown in FIG. 57, the sash member may be slid even further toward a fully open sash position, and may move clear of the vent stop 200. Once clear of the vent stop 200, the tumbler 280 is no longer prevented from reaching the second tumbler position, and is biased thereto, as seen in FIG. 58. As the sash member 299 is moved back towards the closed position, it may contact a portion of the top surface 283 proximate to the second end 282 of the tumbler and oppose the biasing for the tumbler to pivot until it again occupies the position shown in FIG. 57. From that position, as noted above, subsequent movement of the sash member 299 toward the closed sash position would move the sash member clear of the vent stop 200, and the tumbler 280 would again be biased into the second tumbler position shown in FIG. 58.

As various changes could be made in the above constructions without departing from the scope of the invention, it is intended that all matter contained in the above description shall be interpreted as illustrative and not in a limiting sense.

What is claimed is:

1. A vent stop, for use in an opening of a stile of a sash window, said vent stop comprising:

a housing, said housing comprising: a top plate; one or more walls, said one or more walls joined to and extending from a bottom surface of said top plate to create a cavity; and a bottom wall connected to said one or more housing walls: at least a portion of said top plate overhangs beyond at least a portion of said one or more walls to create a lip, said top plate comprising an opening into said cavity;

a first retention member configured to secure a first end of said housing to a first end of the opening in the window stile;

a second retention member configured to secure a second end of said housing to a second end of the opening in the window stile;

a tumbler pivotally mounted in said housing cavity, wherein actuation of an exposed tumbler surface proximate to a first end of said tumbler causes said tumbler to pivot from a first tumbler position into a second tumbler position; and wherein actuation proximate to said second end of said tumbler causes said tumbler to pivot from said second tumbler position into said first tumbler position;

a flexible elongated member connected to said tumbler to bi-directionally bias said tumbler, wherein a distal end of said flexible elongated member contacts and selectively moves with respect to an apex formed on said bottom wall of said housing that creates at least a first surface and a second surface on said bottom wall;

wherein when said tumbler is in said first tumbler position, the actuation proximate to said first end of said tumbler causes said distal end of said flexible elongated member to cross said apex, and subsequent contact between said distal end of said flexible elongated member and said first surface on said bottom wall of said housing biases said tumbler to pivot further toward said second tumbler position; and wherein when said tumbler is in said second tumbler position, actuation of said second end of said tumbler causes said distal end of said flexible elongated member to cross said apex, and subsequent contact between said distal end of said flexible elongated member and said second surface on said bottom wall of said housing biases said tumbler to pivot further toward said first tumbler position.

2. The vent stop according to claim 1 further comprising a stop arrangement configured to limit said biased pivotal travel of said tumbler to said second tumbler position.

3. The vent stop according to claim 2 further comprising a second stop arrangement configured to limit said biased pivotal travel of said tumbler to said first tumbler position.

4. The vent stop according to claim 1 wherein said first end of said tumbler protrudes out from said opening in said top plate of said housing in said first tumbler position.

5. The vent stop according to claim 4 wherein said second end of said tumbler protrudes out from said opening in said top plate of said housing in said second tumbler position.

6. The vent stop according to claim 1 wherein said flexible elongated member is connected with said tumbler by being integrally formed therewith as a single unitary part.

7. The vent stop according to claim 1 wherein said flexible elongated member is connected to said tumbler by a curved portion of said flexible elongated member being slidably received in a recess in said tumbler.

8. A window vent stop, for use in an opening of a stile to releasably restrict sliding of a sash window to a limited open position, said vent stop comprising:

a housing comprising: a top plate; one or more walls, said one or more walls joined to and extending from a bottom surface of said top plate to create a cavity; a bottom wall: said top plate comprising an opening into said cavity;

means for securing a first end of said housing to a first end of the opening in the stile;

means for securing a second end of said housing to a second end of the opening in the stile;

a tumbler pivotally mounted in said housing cavity for actuation of an exposed surface proximate to a first end of said tumbler to cause said tumbler to pivot from a first tumbler position into a second tumbler position, and for actuation of said second end of said tumbler to cause said tumbler to pivot from said second tumbler position into said first tumbler position;

a flexible elongated member connected to said tumbler to bi-directionally bias said tumbler, wherein a distal end of said flexible elongated member contacts and selectively moves with respect to an apex formed on said bottom wall of said housing that creates a first surface and a second surface on said bottom wall;

wherein movement of said distal end of said flexible elongated member across said apex onto said first surface biases said tumbler to pivot toward said second tumbler position; and wherein movement of said distal end of said flexible elongated member across said apex onto said second surface biases said tumbler to pivot toward said first tumbler position.

9. The window vent stop according to claim 8 further comprising a stop arrangement configured to limit said biased pivotal travel of said tumbler to said second tumbler position.

10. The window vent stop according to claim 9 further comprising a second stop arrangement configured to limit said biased pivotal travel of said tumbler to said first tumbler position.

11. The vent stop according to claim 8 wherein said first end of said tumbler protrudes out from said opening in said top plate in said first tumbler position.

12. The vent stop according to claim 1 wherein said second end of said tumbler protrudes out from said opening in said top plate in said second tumbler position.

13. The vent stop according to claim 8 wherein said flexible elongated member is connected with said tumbler by being integrally formed therewith as a single unitary part.

14. The vent stop according to claim 8 wherein said flexible elongated member is connected to said tumbler by a curved portion of said flexible elongated member being slidably received in a recess in said tumbler.

* * * * *